US006550408B1

(12) United States Patent
Janssen

(10) Patent No.: US 6,550,408 B1
(45) Date of Patent: Apr. 22, 2003

(54) METHOD AND APPARATUS FOR LOADING AND UNLOADING CARGO FROM A TWIN-HULL SEA-GOING SHIP

(76) Inventor: Hermann J. Janssen, D-26725 Emden, Martin-Faber-Strasse 1 (DE)

( * ) Notice: Subject to any disclaimer, the term of this patent is extended or adjusted under 35 U.S.C. 154(b) by 0 days.

(21) Appl. No.: 10/033,865

(22) Filed: Dec. 19, 2001

(51) Int. Cl.[7] ..... B63B 9/08
(52) U.S. Cl. ..... 114/121
(58) Field of Search ..... 114/121, 125, 114/72, 259, 260

(56) References Cited

U.S. PATENT DOCUMENTS 3,939,790 A * 2/1976 Varges et al. ..... 114/259
4,147,123 A * 4/1979 Kirby et al. ..... 114/260

FOREIGN PATENT DOCUMENTS

DE 42 29 706 A1 3/1994

OTHER PUBLICATIONS

Trail Reports in Transportation Planning No. R99/01 The Netherlands Trail Research School (1999).

* cited by examiner

*Primary Examiner*—Ed Swinehart
(74) *Attorney, Agent, or Firm*—John R. Mugno

(57) ABSTRACT

A method of loading floatable containers onto, and discharging floatable containers from, a seaworthy vessel to facilitate the transport of cargo. The vessel includes twin hulls which lie beneath the water's surface, a device for controlling the draft and the horizontal position of the vessel, a plurality of submersible platforms each of which lies on a longitudinally and transversely subdivided controllable air cell, device for controlling the draft and the horizontal position of the submersible platforms, and transverse trusses having engagement devices to support said platforms. The levels and the horizontal position of both the hulls and the aforementioned platforms are manipulated by air provided by on-board turbo air compressors running open-loop within their speed-delivery characteristics and/or by air vented from the hulls and the aforementioned platforms, regulated by valves controlled by a central processor with software for the continuous automatic correcting of calculated valve setting programs and for using the valve setting programs corrected during the preceding load cycle for the subsequent discharge cycle, to permit for efficient changes between loading draft and voyage draft.

4 Claims, 12 Drawing Sheets

METHOD AND APPARATUS FOR LOADING AND UNLOADING CARGO FROM A TWIN-HULL SEA-GOING SHIP

FIELD OF THE INVENTION

This invention is generally directed to the effective loading and unloading of cargo from a seaworthy ship. More specifically, the method and apparatus of the present invention provides for the efficient loading and unloading of floatable cargo containers onto submersible platforms of twin-hull ships. The method and apparatus of the present invention is particularly effective for the short-sea trade.

BACKGROUND OF THE INVENTION

As global commerce has expanded, it has become increasingly necessary to effectively transport goods from one location to a remote location that transverses over water. Containers of goods are transported inland by means of railroads, trucks, inland waterway vessels, etc. The permissible range of operation of land-bound carriers or vessels for inland navigation ends at the coast. At that point, cargo transported by inland waterway vessels and to be carried across the sea must be transferred from a non-seaworthy inland vessel to a seaworthy ship.

It is most inconvenient, time-consuming and costly to transfer goods from inland waterway vessels to seaworthy ships, particularly if the goods contained within the waterway vessels need to be repackaged. In utilizing such known techniques, it is often similarly necessary to again repackage the cargo when the seaworthy ship arrives at the importing port and the optimal inland carrier would be inland vessels.

In the prior art, numerous types of vessels for carrying laden inland waterway vessels across the sea were developed. For example, the prior art provides a LASH ("Lighter Aboard SHip") carrier, a BACO ("BArge/Container") liner, and a BarCat ("BARge CATamaran") ship. Each of these prior art vessels requires application specific machinery.

The prior art LASH carrier and BACO liner are ships primarily designed for the deep-sea trade in which time expended for cargo handling after a typically long voyage is less critical than in the short-sea trade with its frequent layover times after short voyages. Both LASH carriers and BACO liners utilize barges specifically built for the carrier vessel. This greatly enhances costs. The LASH carrier takes these barges aboard one after another by means of a shipborne crane, while the BACO liner floats the barges in and out one after another through its bowgate. Accordingly, the exchange of incoming versus outgoing barges takes much time that contributes to these deep-sea barge carriers not being economically viable in the short-sea trade. The considerably smaller BarCat also relies on barges built specifically for the carrier ship and has proven uneconomical because of its relatively small size.

The LASH carrier, the BACO liner, the BarCat ship, and other earlier barge carriers employ barges specifically built for the carrier vessel. All of these prior art barges are smaller than inland barges and, because of their small size, are less—or not at all—economically viable in inland navigation. In fact, the repacking of cargo may be required. Additionally, the exchange of arriving versus departing barges takes too much time to be economically viable in the short-sea trade.

Particularly for the short-sea trade, a semi-submersible or SWATH ("Small Water-plane Area Twin Hull") ship has garnered particular attention as a special barge carrier that would effectively transport laden inland vessels across the sea. SWATHs are multi-hulled ships. Each hull is narrow in the plane of the water surface, providing a much greater cross section deeper below the surface. Due to this configuration, a SWATH has no cargo holds inside the hull (dry holds) as is characteristic of conventional vessels, but must carry dry cargo on deck, while the lower section of the hull serves as a buoyant body only. The buoyant body contains ballast tanks which, depending on the various load conditions of the SWATH, are filled with more or less water for keeping the vessel at an effective operating draft. Because it can carry its cargo on deck, a SWATH can accommodate full-size inland waterway vessels of all types such as lighters, push barges, self-propelled barges, or any other floatable containers. Of course, in order to benefit from this advantage, as well as from its economy of scale for the short-sea trade, a large SWATH-type barge carrier must be able to rapidly discharge and load floatable containers despite its larger size.

A specific embodiment of a large SWATH proposed as a carrier ship for floatable containers is described in German Patent Application Serial No. DE 42 29 706 A1, which was invented by the same inventor as the present invention. The ship disclosed in the aforementioned German patent application has been referred to as a Trans Sea Lifter ("TSL"). While the aforementioned German patent application is hereby incorporated into this patent by this reference, it is different than the TSL ship shown in FIG. 1. The TSL ship 100 of FIG. 1 has submersible platforms capable of receiving numerous barges—i.e., floatable containers—in a variety of sizes, not only standard barges. However, due to the carrying of different barges, or of a different number of barges, the process of immersing or raising the platforms is more complex and constitutes part of the present invention.

Ship 100 is a SWATH in the form of a catamaran that, between its bow and stern structures, is subdivided by transverse trusses 5 into several cargo spaces, each of which is equipped with a submersible platform 4 between vertical guides. The submersible platform 4 is capable of being flooded and de-watered for loading and discharging floatable containers 12. When ship 100 is on the sea, the submersible platform 4 should sit well above the water. When exchanging floatable containers laden with goods, ship 100 should increase its draft until its submersible platforms 4 become waterborne. After submersible platforms 4 are submerged, the floatable containers 12 arranged on their deck become waterborne and are exchanged with new floatable containers. Newly laden with floatable containers 12, the submersible platforms 4 should resurface out of the water when ship 100 prepares for continuing its voyage.

While the aforementioned German patent application provided a TSL extremely effective for short-sea trade, new means have been provided for effectively controlling the level of the submersible platforms 4 of ship 100 for loading, unloading, and sea travel.

It is therefore a primary object of the present invention to provide a new and improved method and apparatus for loading and unloading cargo from a multi-hull ship.

It is another object of the present invention to provide a new and improved method and apparatus for loading and unloading cargo from a multi-hull ship in a more economical manner.

It is yet a further object of the present invention to provide a new and improved method and apparatus for loading and unloading cargo from a multi-hull ship at a faster speed.

It is another object of the present invention to provide a new and improved method and apparatus for loading and unloading of floatable containers wherein the ship can accommodate cargo-laden floatable containers of various sizes.

It is yet still a further object of the present invention to provide a new and improved method and apparatus for loading and unloading of floatable containers wherein loading and unloading can be performed simultaneously.

It is still another object of the present invention to provide a new and improved method and apparatus for loading and unloading cargo from a multi-hull ship wherein the levels of the receiving floatable platforms of the ship can be readjusted periodically.

Other objects and advantages of the present invention will become apparent from the specification and the drawings.

SUMMARY OF THE INVENTION

Briefly stated and in accordance with the preferred embodiments of the present invention, . . .

BRIEF DESCRIPTION OF THE DRAWINGS

While the specification concludes with claims particularly pointing out and distinctly claiming the subject matter regarded as the invention herein, it is believed that the present invention will be more readily understood upon consideration of the description, taken in conjunction with the accompanying drawings, wherein:

DESCRIPTION OF THE PERFERRED EMBODIMENT

Figure 1:
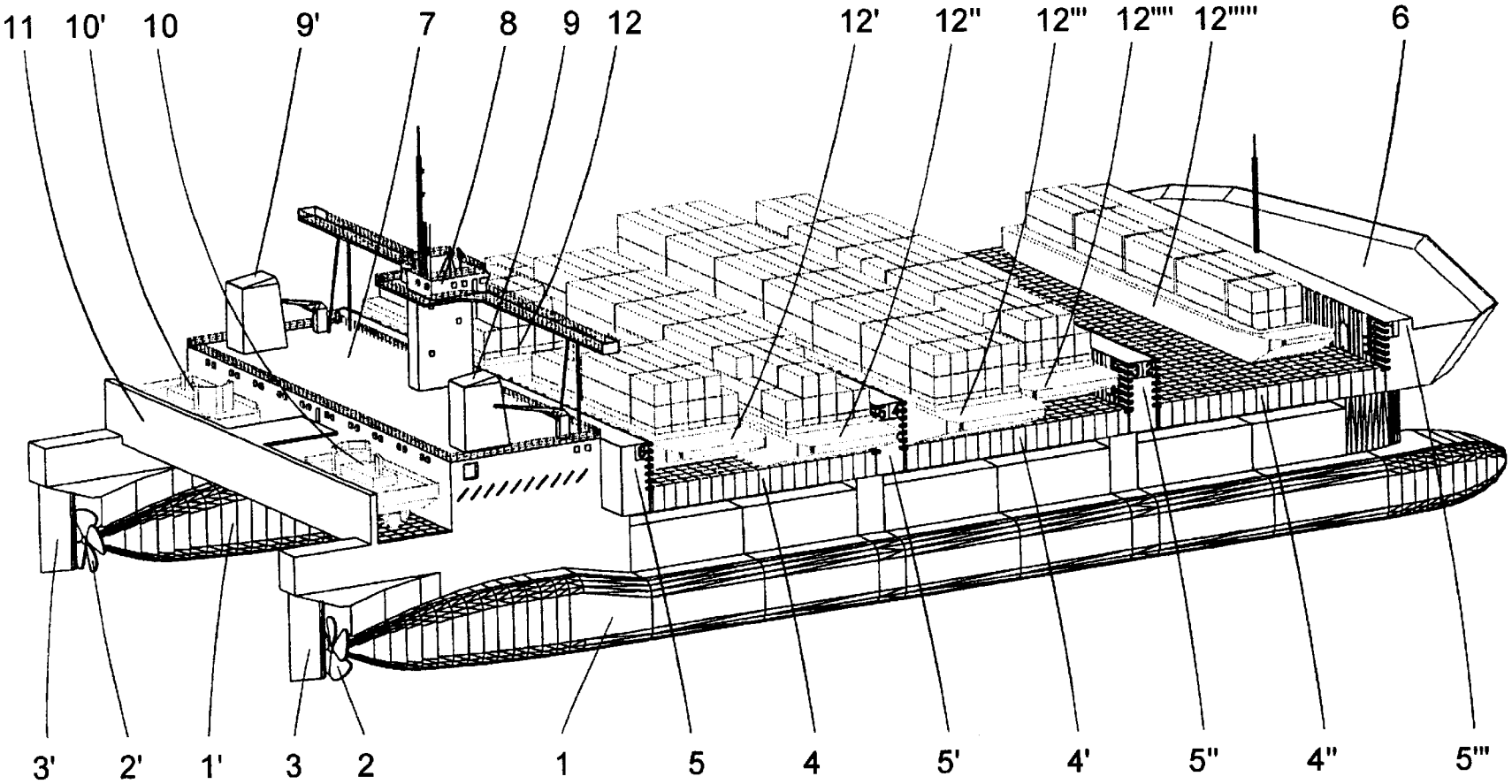
FIG. 1 is a schematic illustration of a twin-hull ship utilized in accordance with the present invention.

Referring first to FIG. 1, a twin-hull TSL, generally designated 100, is shown. While the preferred embodiment of the present invention will be described in connection with a twin-hull TSL, it is equally effective with ships having adjustable submersible loading platforms and more than two hulls. Ship 100 has hulls 1 and 1', propellers 2 and 2', and rudders 3 and 3'. Submersible platforms 4, 4' and 4" are seated on supports (not shown in FIG. 1) between transverse trusses 5, 5', 5" and 5'" which, together with the structures of a forecastle 6 and a poop 7, connect hulls 1 and 1' to each other. A bridge 8 and smoke stacks 9 and 9' of the propulsion plants (not shown) in hulls 1 and 1' are arranged on poop 7. There are two optional barge handling tugs 10 and 10', which are stored in a berth 11 aft of poop 7. These optional tugs 10 and 10' provide assistance for loading waterborne floatable containers 12, 12', 12", 12'", 12"" and 12""" off and onto submerged submersible platforms 4, 4' and 4". Obviously, for self-propelled inland waterway vessels and similar floatable containers, optional tugs 10 and 10' are unnecessary.

Figure 2:
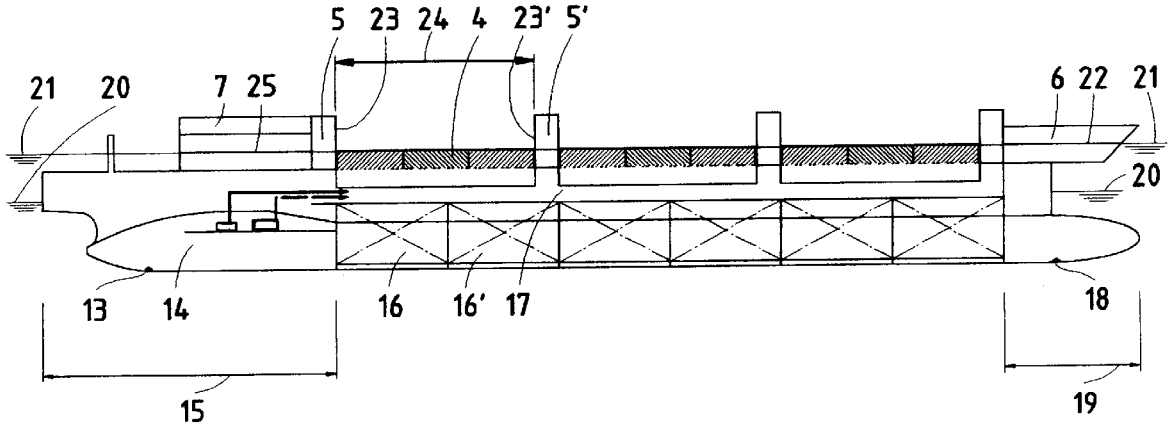
FIG. 2 is a schematic, longitudinal view of the twin-hull ship utilized in accordance with the present invention.
Figure 3:
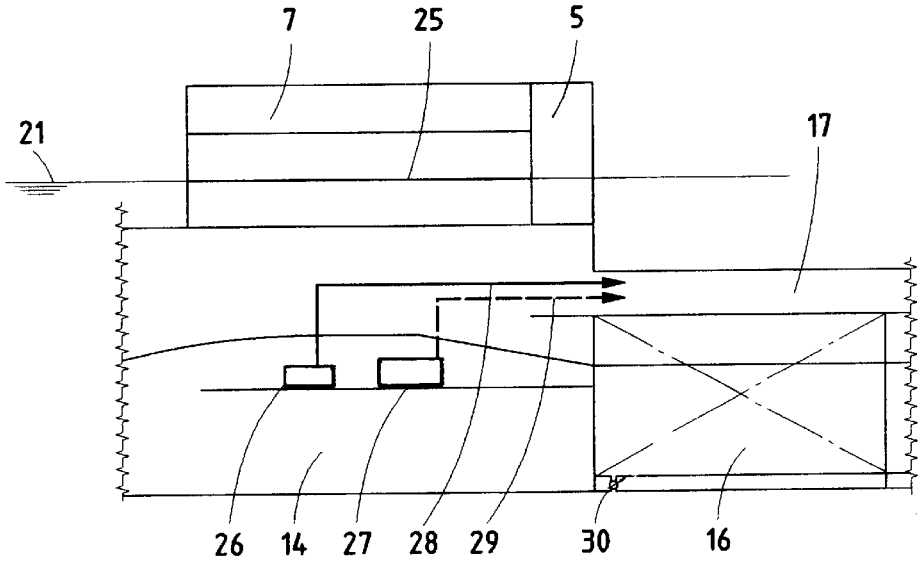
FIG. 3 is an exploded view of the afterbody 15 of the twin-hull ship of FIG. 2 utilized in accordance with the present invention.

Referring next to FIG. 2, the longitudinal view of hull 1 in ship 100 is shown. The view of hull 1' would be identical. An afterbody 15 includes a pressure sensor 13 and an engine room 14. FIG. 3 is an exploded view of afterbody 15, and further includes a hull tank 16 and a service alleyway 17. A cargo space 24 is created between transverse trusses 5 and 5'. Hull tanks 16 and 16' and service alleyway 17 below submersible platform 4 are within cargo space 24. A turbo compressor 26 generates compressed air for controlling the level of submersible platforms 4, 4' and 4" by means of a compressed air main 28. Similarly, a turbo compressor 27 generates compressed air to hull tanks 16 and 16' by means of a compressed air main 29. As mentioned above, submersible platforms 4 fit on supports at the sides 23 and 23' of adjacent transverses trusses 5 and 5'. When ship 100 and submersible platforms 4, respectively, are re-emerging, a high volume of compressed air at relatively low, continuously changing pressure is required from turbo compressor 26 and turbo compressor 27 for ejecting water from hull tanks 16 and submersible platforms 4, respectively. Because of the quick sequence of operations and the high volume of air, turbo compressor 26 and turbo compressor 27 are typically high electrically-powered turbo compressors. Such available compressors are known in the art.

Figure 4:
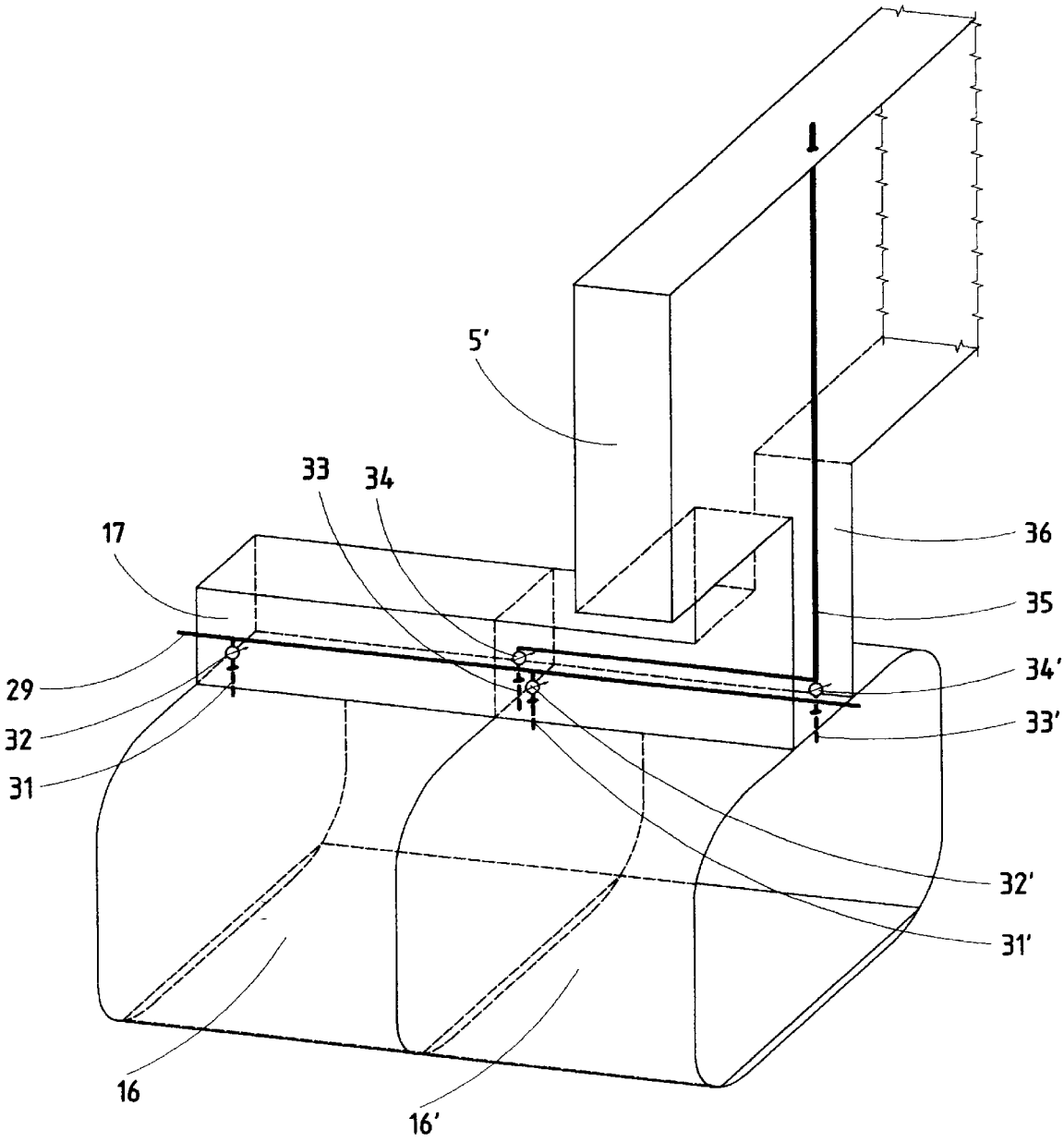
FIG. 4 is a schematic illustration of air piping systems for venting air from, and for injecting air into, hull tanks of the twinhull ship in accordance with the present invention.
Figure 5:
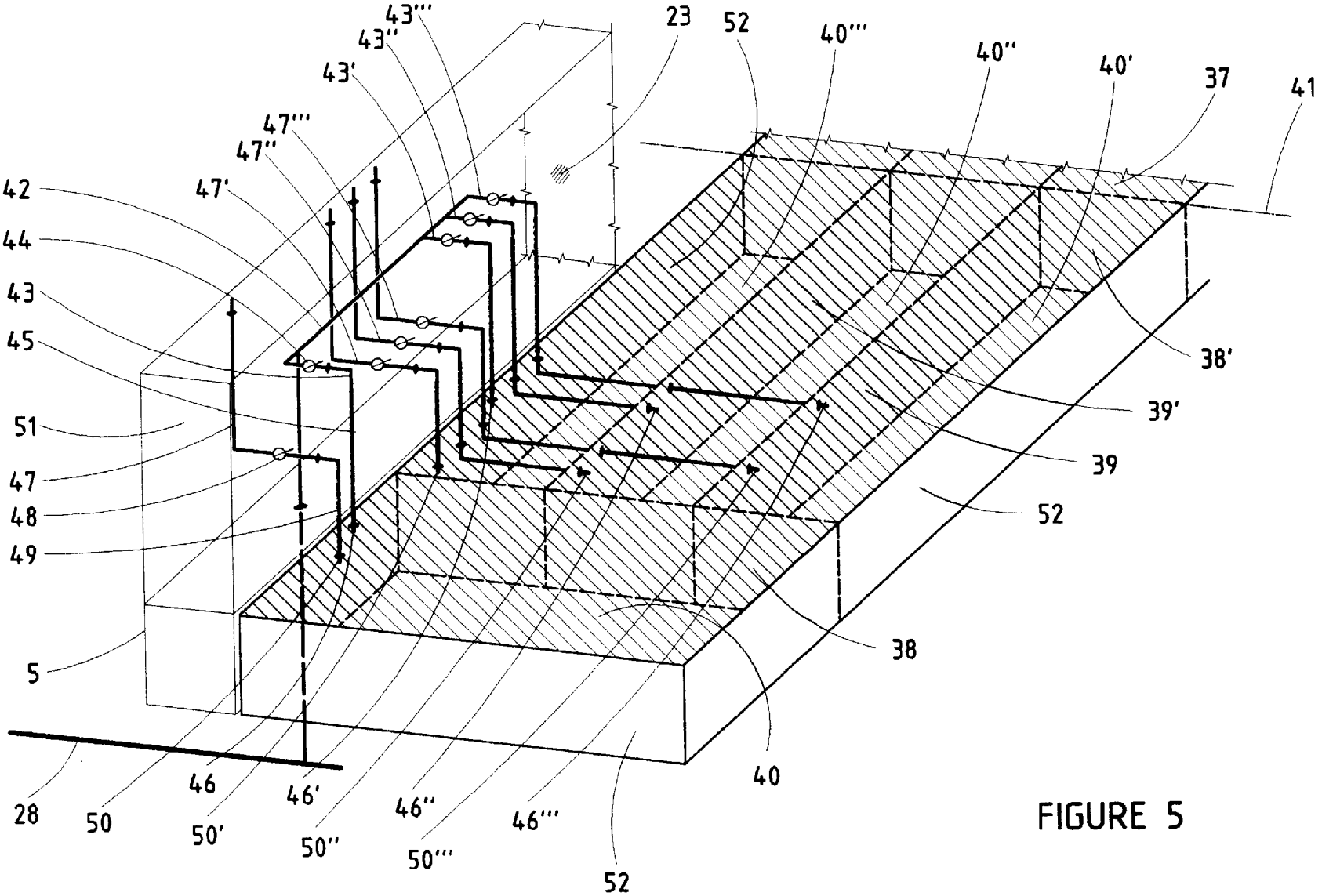
FIG. 5 is a schematic illustration of air piping systems for venting air from, and for injecting air into, cells of a submersible platform of the twin-hull ship in accordance with the present invention.

Compressed air for hull tank 16 is generated by turbo compressor 27 in engine room 14. Except for limiting minimum delivery pressure, turbo compressors 27 generally run openloop within their operating range because delivery volume and pressure are regulated by check valves 32 of a piping system 31 (FIG. 4). Compressed air at lower delivery pressure for the submersible platforms 4 is generated by turbo compressor 26 in engine room 14 of hulls 1 and 1'. Each turbo compressor 26 supplies cells 40, 40', 40" and 40'" of one half-side of all submersible platforms 4. This arrangement is best seen in FIG. 5. Turbo compressors 26 also generally run open-loop within their operating range because delivery volume and pressure are regulated by check valves 44 of a piping system 43. The aforementioned pressure sensor 13 in afterbody 15 of ship 100 and a pressure sensor 18 in a forebody 19 of ship 100 are utilized for measuring water pressure for determining actual draft. A remote-controlled shut-off valve 30 is also made available on the bottom of hull tank 16.

The extreme ends of hulls 1 and 1' of ship 100 are connected in forebody 19 by forecastle 6 and in afterbody 15 by poop 7. When ship 100 is at voyage draft, hulls 1 and 1' in forebody 6 and afterbody 15 bear only their own weight and that of the deck structures of forecastle 6 and poop 7 above them. The water surface during voyage draft is reflected by water level 20 in FIG. 2. When ship 100 re-immerses to loading draft, forebody 19 and afterbody 15 immerse by flooding assigned ballast tanks 16 and 16' in hulls 1 and 1'. The water surface during loading draft is reflected by water level 21 in FIG. 2. The volume of water which hull tanks 16 and 16' take in is equal to the small volume of water which the above-water components of forecastle 6 and poop 7 displace when they are immersed with ship 100. At this point, the water-tight margin plating 52 of the lowest water-tight decks 22 and 25 in forecastle 6 and poop 7, respectively, extend below a deck 37. Vent pipes 47 open the volume encompassed by deck 37 and margin plating 52 to the atmosphere so that no air cushion is captured when forecastle 6 and poop 7 sink into the water with immersing ship 100.

When ship 100 sails at voyage draft, the lowest water-tight deck 22 in forecastle 6 as M) shown in FIG. 2 sits several meters above the water surface. However, when ship 100 is immersed to loading draft, water-tight deck 22 lies exactly in the water surface so that forecastle 6 has a buoyant body and stabilizes ship 100 at its bow. The same principle applies to lowest water-tight deck 25 in poop 7 which, thus, correspondingly stabilizes ship 100 at its stern.

FIG. 4 shows an example wherein service alleyway 17 contains the air piping systems for both injecting air into, and for venting air from, hull tanks 16 and 16'. These piping systems are dimensioned in ship 100 to immerse and re-emerge within the programmed time span at a throughput of air equal to 90% of full capacity, thus providing a range of plus/minus 10% for regulating the air flow rate.

Compressed air main 29 is connected to hull tanks 16 and 16' by branch lines 31 and 31' that are equipped with remote-controlled check valves 32 and 32' for regulating air flow into assigned hull tanks 16 and 16'. Hull tanks 16 and 16' are vented by assigned pipe lines 33 and 33' that are equipped with remote-controlled check valves 34 and 34' for regulating the flow of outgoing (i.e., vented) air. Pipe lines 33 and 33' in service alleyway 17 are connected to a common line 35 which runs upward through a column or stanchion 36 and transverse truss 5' to emit outgoing air into the atmosphere.

FIG. 5 shows a part of cargo space 24 with submersible platform 4 and the piping systems which vent submersible platform 4 for submerging and supply it with compressed air for re-emerging. Within the boundary of water-tight margin plating 52, submersible platform 4 below its deck 37 is subdivided into cells 40, 40', 40" and 40'" by water-tight longitudinal bulkheads 38 and 38' and transverse bulkheads 39 and 39'. When submersible platform 4 is waterborne, each of cells 40, 40', 40" and 40'" contains a separate air cushion. The piping systems for venting and/or injecting compressed air are dimensioned for submersible platform 4 to submerge and re-emerge within the programmed time span by a throughput of air equal to 90% of full capacity, thus providing a range of plus/minus 10% for regulating the air flow.

Cells 40, 40', 40" and 40'" of each half-side of submersible platforms 4 between a centerline 41 and the outboard edge of submersible platform 4 are supplied with compressed air by compressed air main 28, which is contained in service alleyway 17 in hulls 1 and 1' below the corresponding outboard edge of submersible platform 4. A branch of compressed air main 28 runs through columns or stanchions 36 upward into a service alleyway 51 in transverse truss 5 where, as a main line 42, it supplies compressed air to submersible platform 4. Branch lines 43, 43', 43" and 43'" from main line 42 are linked by hose connections 45 to branch lines 46, 46', 46" and 46'", which end in assigned cells 40, 40', 40" and 40'" inside submersible platform 4. The configuration of branch line 43 with remote-controlled check valve 44 for regulating the flow of compressed air and a hose connection 45 to assign pipe section 46 inside cell 40 of submersible platform 4 is typical of all branch lines for compressed air. All check valves 44 are located inside service alleyway 51.

Cells 40, 40', 40" and 40'" of submersible platforms 4 are vented directly by vent lines 47, 47', 47" and 47'"; a hose connection 49; and assigned pipe section 50, 50', 50" and 50'" in assigned cells 40, 40', 40" and 40'" of submersible platform 4. The configuration of vent line 47 with a remote-control check valve 48 for regulating the flow of outgoing air and a hose connection 49 to assigned pipe section 50' inside submersible platform 4 is typical of all branch lines for venting the compressed air. All checked valves 48 are also located in service alleyway 51.

Figure 6B:
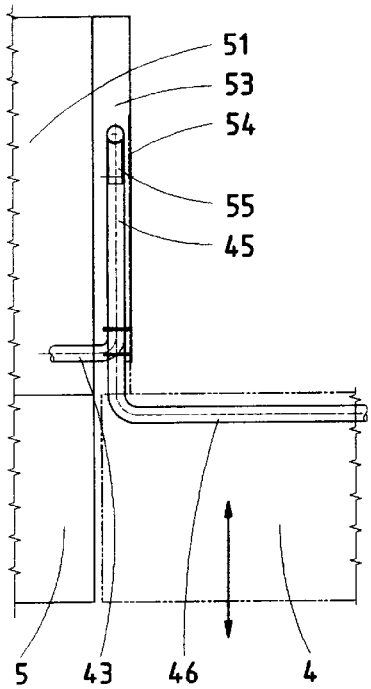
FIGS. 6*a*, 6*b* 6*c* are various illustrations of hose connections between a transverse truss and the submersible platform of the twin-hull ship utilized in accordance with the present invention.
Figure 6A:
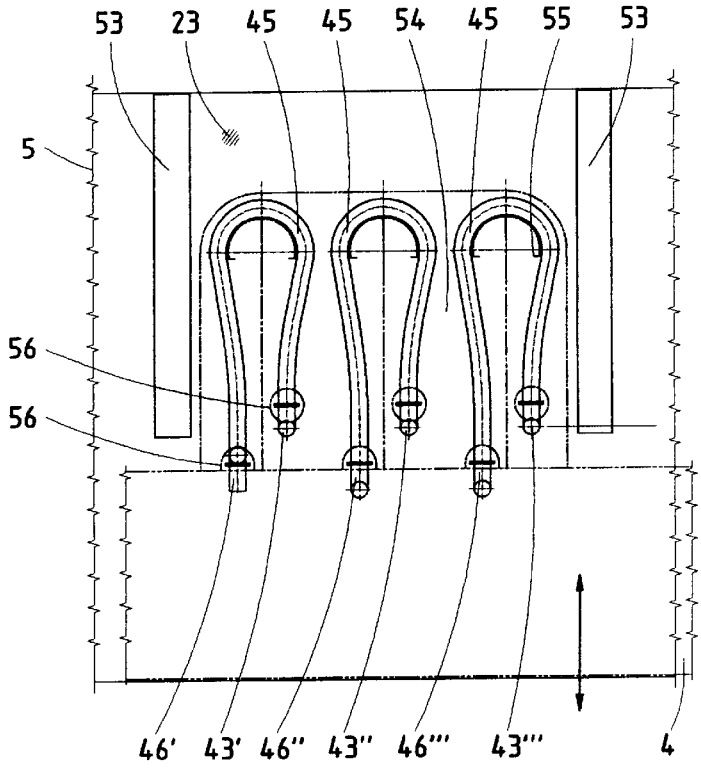
Figure 6C:
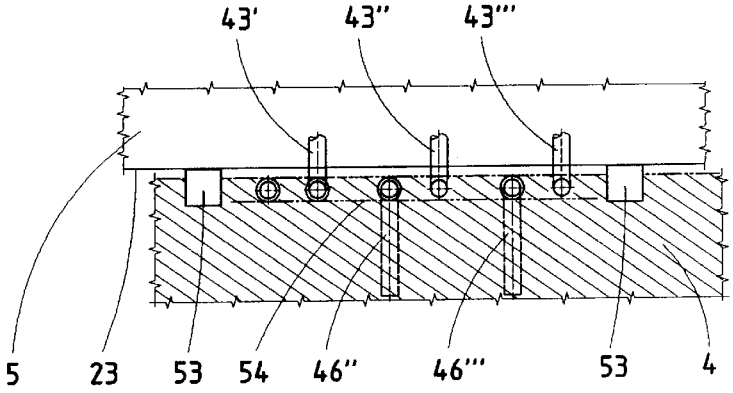

FIGS. 6*a*, 6*b*, and 6*c* are a side view, a plan view and a cross sectional view, respectively, of the preferred hose connections by means of branch lines 43, 43', 43" and 43'" between the piping system and service alleyway 51 of transverse truss 5 and the pipe sections 46, 46', 46" and 46'" in submersible platform 4. Typically, a hose connection 45 consist of a hose with a flange at each end which connects branch lines 43', 43" and 43'" to corresponding pipe sections 46, 46', 46" and 46'". In order to minimize the possibility of damage by moving floatable containers 12, hoses 45 are arranged behind a protective shield 54 which is attached to deck 37 of submersible platform 4. Hoses 45 are looped over a guide yoke 55 mounted on protective shield 54 so that, when submersible platform 4 is fully submerged and rests in its deep position on hulls 1 and 1", the length of the then-extended hoses 45 suffices for the distance between transverse truss 5 and submersible platform 4. Openings 56 in protective shield 54 provide access to the flanges between hoses 45 and all aforementioned pipes. Fenders 53, arranged vertically on transverse truss 5 along both sides of protective shield 54, prevent hoses 45 from drifting sideways when submersible platform 4 is submerged.

Figure 7:
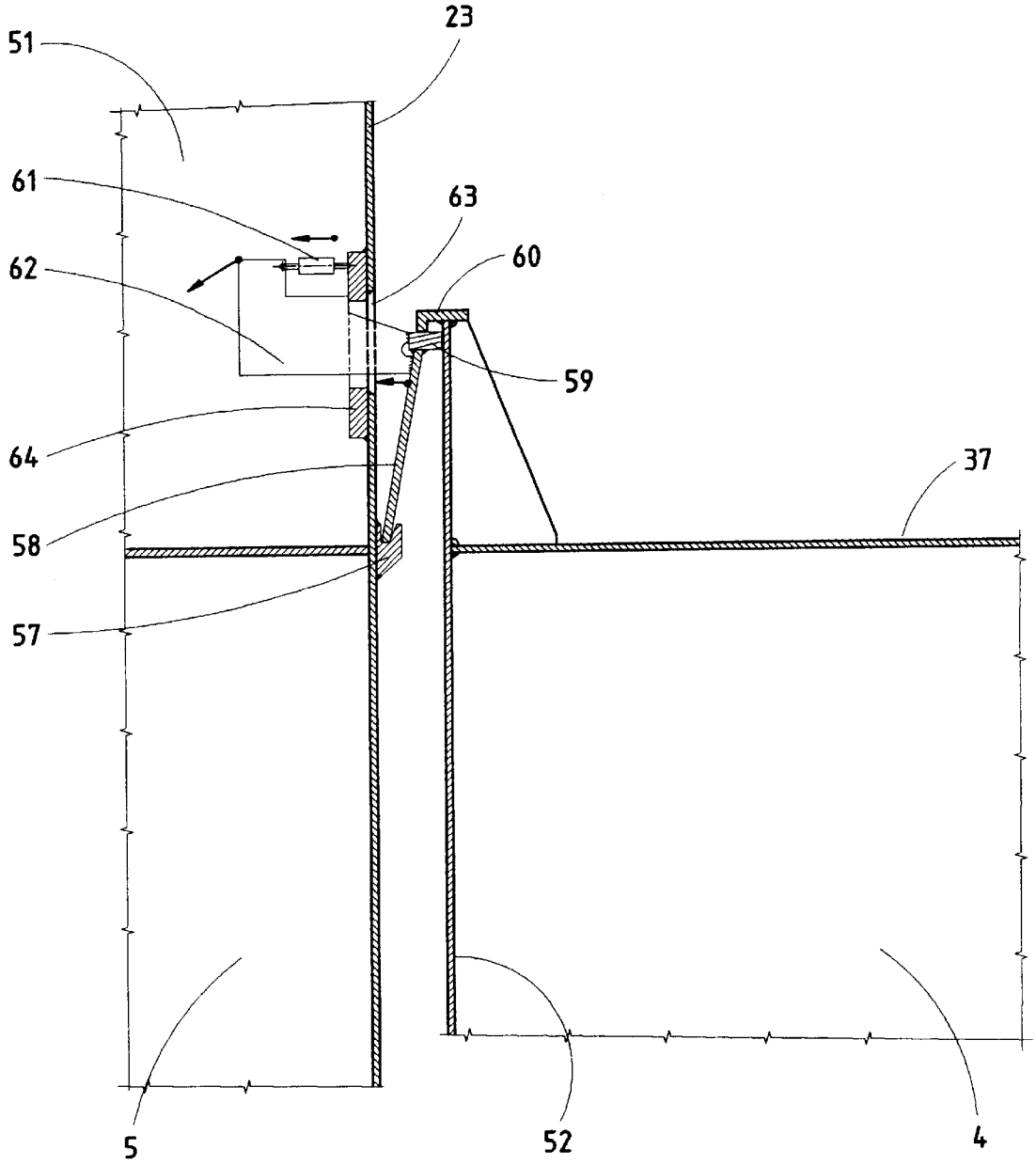
FIG. 7 is a schematic illustration of the support of a submersible platform at the transverse truss in the twin-hull ship utilized in accordance with the present invention.

Turning now to FIG. 7, the typical support mechanism of submersible platform 4 at transverse truss 5 is illustrated. Attached to side 23 of transverse truss 5 (that faces submersible platform 4) is a bearing rail 57 that carries a tiltable support rail 58. Subdivided into sections, bearing rail 57 and tiltable support rail 58 extend over the entire width of transverse truss 5. Affixed to the top of support rail 58 is a top rail 59 on which a bearing bar 60 of submersible platform 4 is carried. Bearing bar 60 is a continuous bar along the entire width of submersible platform 4, being fixed to margin plating 52 of submersible platform 4, which itself extends above deck 37. When ship 100 sails at voyage draft, submersible platform 4 rests with bearing bars 60 on top rails 59 and its bottom lies several meters above water. When ship 100 is immersed to loading draft, submersible platform 4 is waterborne at the programmed freeboard. In this position, bearing bar 60 of submersible platform 4 sits above top rail 59 so that no load remains on support rail 58. After having been unburdened, support rails 58 are retracted by an actuator 61 and a lever 62 through openings 63 in the plating of transverse trusses 5. When retracted to transverse trusses 5, the clear width between opposite top rails 59 exceeds the span over bearing bar 60 of submersible platforms 4 so that submersible platforms 4 can pass through when submerging. Transverse displacement of lever 62 is prevented by a guide plate 64. When support rail 58 is extended, e.g., for maintenance purposes, while lying above submersible platform 4, lever 62 butts against guide plate 64 before support rails 58 can tilt beyond the operating range of actuator 61. The position of support rails 58, either fully retracted or fully extended, is monitored by photo cells (not shown).

When surfacing, submersible platform 4 rises through the gap between retracted top rails 59 up to the programmed freeboard, at which point, its bearing bars 60 sit above top rails 59. Subsequently, support rails 58 are extended by actuator 61 and butt against margin plating 52 of submersible platform 4. When ship 100 subsequently re-emerges to voyage draft, top rails 59 on transverse trusses 5 rise with it, engage bearing bars 60, and lift submersible platform 4 out of the water.

Figure 8A:
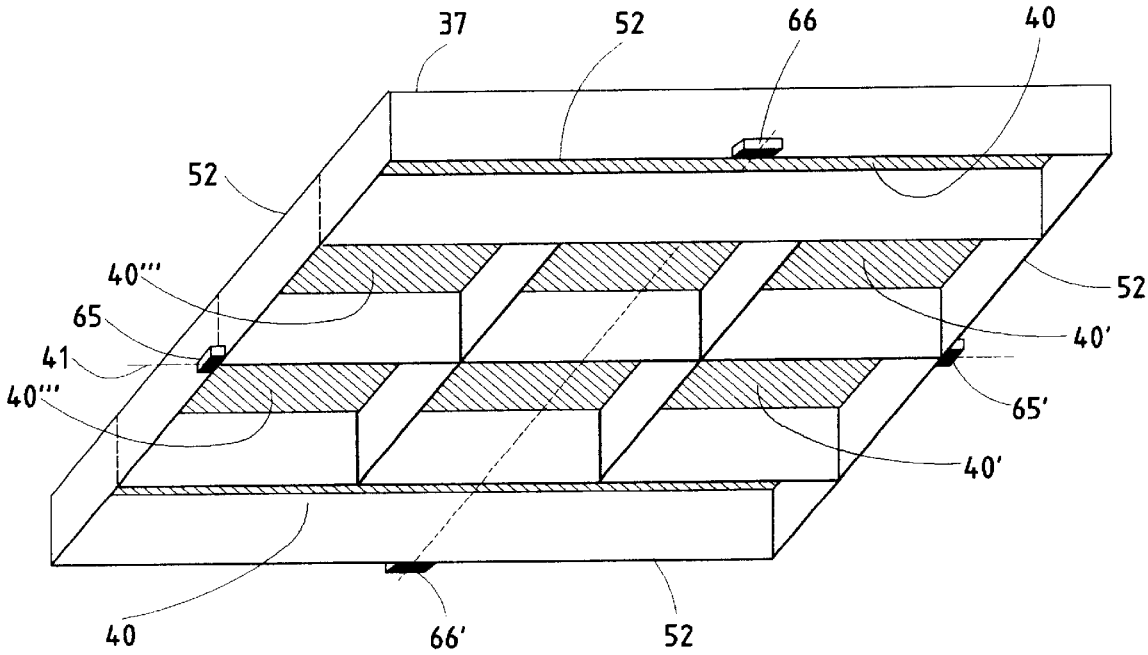
FIGS. 8*a* and 8*b* are schematic illustrations of the arrangement of pressure sensors utilized for measuring depth of the twin-hull ship and its submersible platforms in accordance with the present invention.
Figure 8B:
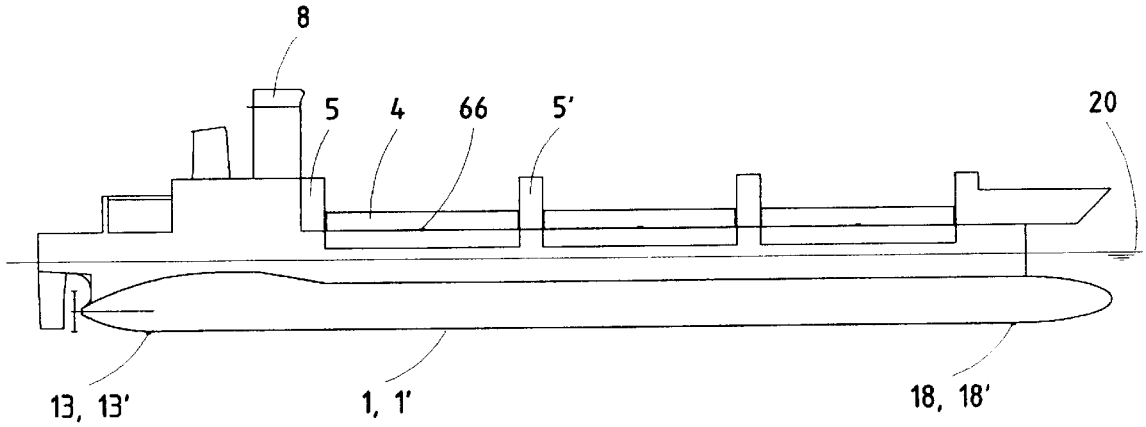

FIGS. 8*a* and 8*b* effectively illustrate the arrangement of pressure sensors 65, 65', 66 and 66' on hulls 1 and 1*a* and submersible platforms 4, 4' and 4". Pressure sensors 65, 65', 66 and 66' provide feedback to the load computer in bridge 8 on actual draft while ship 100 immerses or re-emerges. The side view in FIG. 8*b* shows pressure sensors 18 and 18' arranged at the lowest points of hulls 1 and 1' in forebody 19 as well as pressure sensors 13 and 13' in afterbody 15.

Figure 9A:
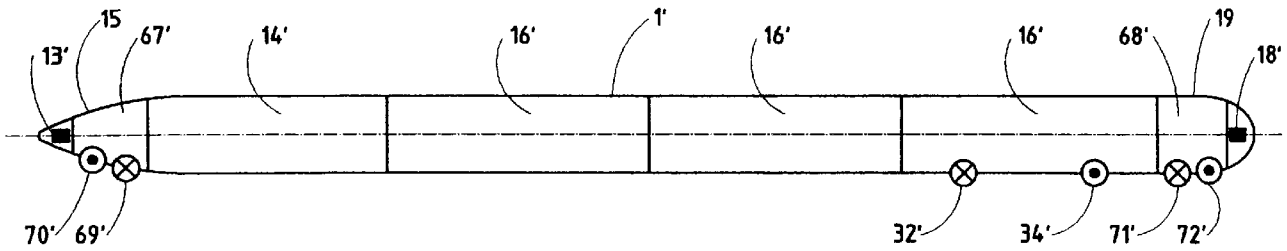
FIGS. 9*a*, 9*b*, and 9*c* are schematic illustrations of the twin hulls and its submersible platform showing air intake and exhaust valves and pressure sensors of the twin-hull ship and its submersible platforms in accordance with the present invention.
Figure 9B:
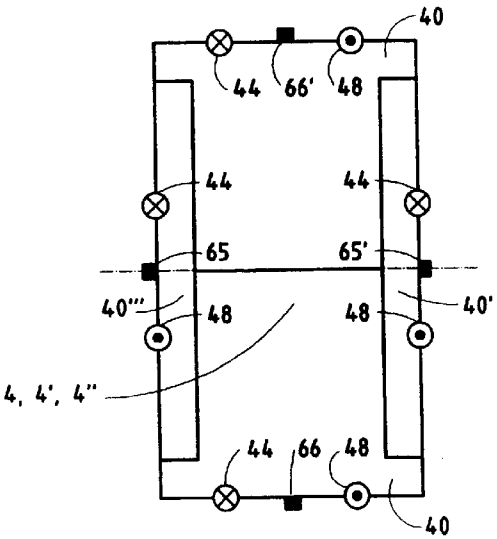
Figure 9C:
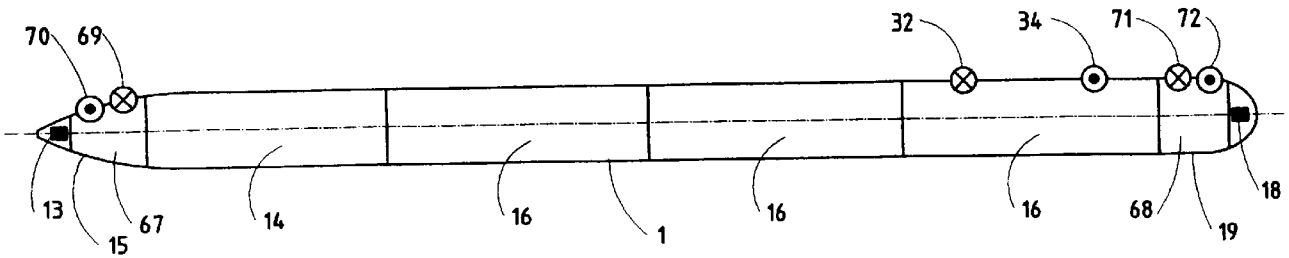

FIGS. 9*a*, 9*b*, and 9*c* are schematic illustrations of the hulls 1 and 1' and the cargo platforms 4, 4' and 4" of ship 100. Shown are pressure sensors 18 and 18' in forebody 19 and pressure sensors 13 and 13' in afterbody 15 of hulls 1 and 1'. Also shown are the exemplary hull tanks 16 and 16' with related air intake check valves 32 and 32' and exhaust check valves 34 and 34'. Similar combinations of air intake check valves 69 and 69' and exhaust check valves 70 and 70' are provided for trimm control tanks 67 and 67' in afterbody 15. Corresponding combinations of air intake check valves 71 and 71' and exhaust check valves 72 and 72' are provided for trimm control tanks 68 and 68' in forebody 19. FIG. 9 shows, furthermore, one of the submersible platforms 4, 4' and 4" with related air intake check valves 44 and exhaust check valves 48 and pressure sensors 65 and 65' at the aft and forward edges and pressure sensors 66 and 66' at the starboard and port outboard edges. The cells 40, 40', 40", and 40'" of the submersible platform 4 are summarily illustrated; however, the differentiation between cells 40 along its port and starboard edges for controlling list—i.e. inclination in transverse direction—and cells 40'" at the aft edge and cell 40' at the forward edge for controlling trimm—i.e. inclination in longitudinal direction—should be noted.

FIGS. 10*a*, 10*b*, 10*c* and 10*d* are simplified operational flow diagrams illustrating the principle of controlling depth and level position of the hulls 1 and 1' and the submersible platforms 4, 4' and 4" of ship 100. They show the overall process flow of the novel method. The top part of each of the diagrams shows the calculation of the control profile of each air intake or exhaust valve which controls the flow of compressed air into or of exhaust air from, a hull tank, or a trimm control tank in the hulls 1 and 1', or a cell of the submersible platforms 4, 4' and 4" of ship 100, all of which are described further below.

Figure 10A:
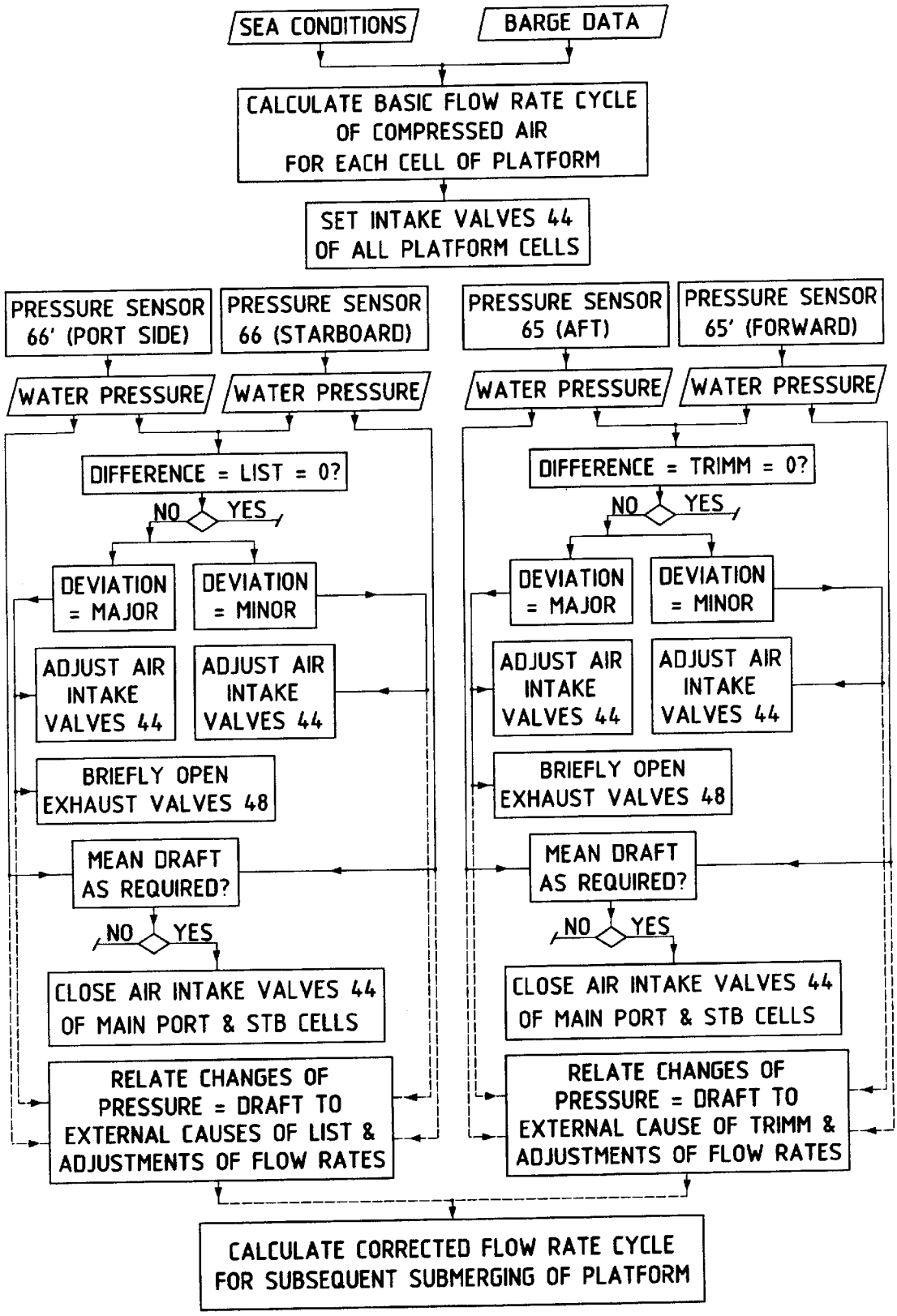
FIGS. 10*a*, 10*b*, 10*c* and 10*d* are flow charts of the operational process that controls the re-emergence and immersion of the twin-hull ship and its submersible platforms in accordance with the present invention.

FIG. 10*a* shows the process flow of one of submersible platforms 4, 4' and 4" when re-emerging with a new load of floatable containers 12 from its deeply submerged position to the water-borne position when the submersible platform 4 has reached the planned draft for being locked into two adjacent transverse trusses 5 and 5' of ship 100.

The process starts with the calculation of the basic flow rate cycle of compressed air into each of the cells 40, 40', 40" and 40'" of submersible platform 4 throughout the re-emergence of submersible platform 4, as shown at the top of the diagram. Constant components of the software for calculating the basic flow rate are the hydrostatic data of ship 100 and the characteristics of turbo-compressors 26 and the piping systems for compressed air and for exhaust air. Current inputs are the sea conditions—e.g. swell, wind pressure—and the barge data—e.g. displacement, draft and their planned distribution on submersible platform 4. Once the calculations are completed, the intake check valves 44 for compressed air for each cell 40, 40' and 40'" are set, following a pre-planned cycle which lasts from the submersible platform 4 rising from its position resting on hulls 1 and 1' to the position where the submersible platform 4 is water-borne at the planned draft.

The lower part of FIG. 10*a* shows in the left half the steps of the process for controlling list and in the right half the steps for controlling trimm of submersible platform 4. Addressing the left half of this part of the diagram, list is present when the water pressure—i.e., depth—measured by pressure sensors 66' at the port edge and pressure sensors 66 at the starboard edge of submersible platform 4 differs. If list does not equal zero, the flow of compressed air into the cells 40 of the submersible platform 4 at the side of the pressure sensor showing the higher water pressure—i.e. having deeper draft—is increased by adjusting the setting of air intake check valve 44. In case of a major deviation, the counter-balancing of list is accelerated by simultaneously releasing a blast of air from cells 40 at the opposite (high) edge of submersible platform 4. When list equals zero, the basic flow rate of compressed air remains as pre-calculated above.

The water pressure read by pressure sensors 65 at the aft edge and 65' at the forward edge of submersible platform 4 is similarly utilized for checking trimm of submersible platform 4 and for counter-balancing trimm by adjusting the flow of compressed air and/or of exhaust air of platform cells 40'" at the aft edge and platform cells 40' at the forward edge of submersible platform 4.

The mean water depth measured by pressure sensors 65 and 65' as well as pressure sensors 66 and 66' is further utilized for checking whether submersible platform 4 has attained the pre-planned draft required for locking it into transverse trusses 5. When this depth is attained, compressed air intake valves 44 of submersible platform 4 are closed.

Next, all adjustments of the basic flow rate cycle are related to the recorded external causes, separate for list and trimm. After elimination of transitory external causes—e.g. an actual gust of wind or the actual swell in a specific roadstead while ship 100 is loading—the remaining validated adjustments are used for calculating the corrected flow rate cycle for the exhaust valves 48 of all platform cells 40, 40', 40" and 40'" for the subsequent submerging of submersible platform 4 with the same load.

Figure 10B:
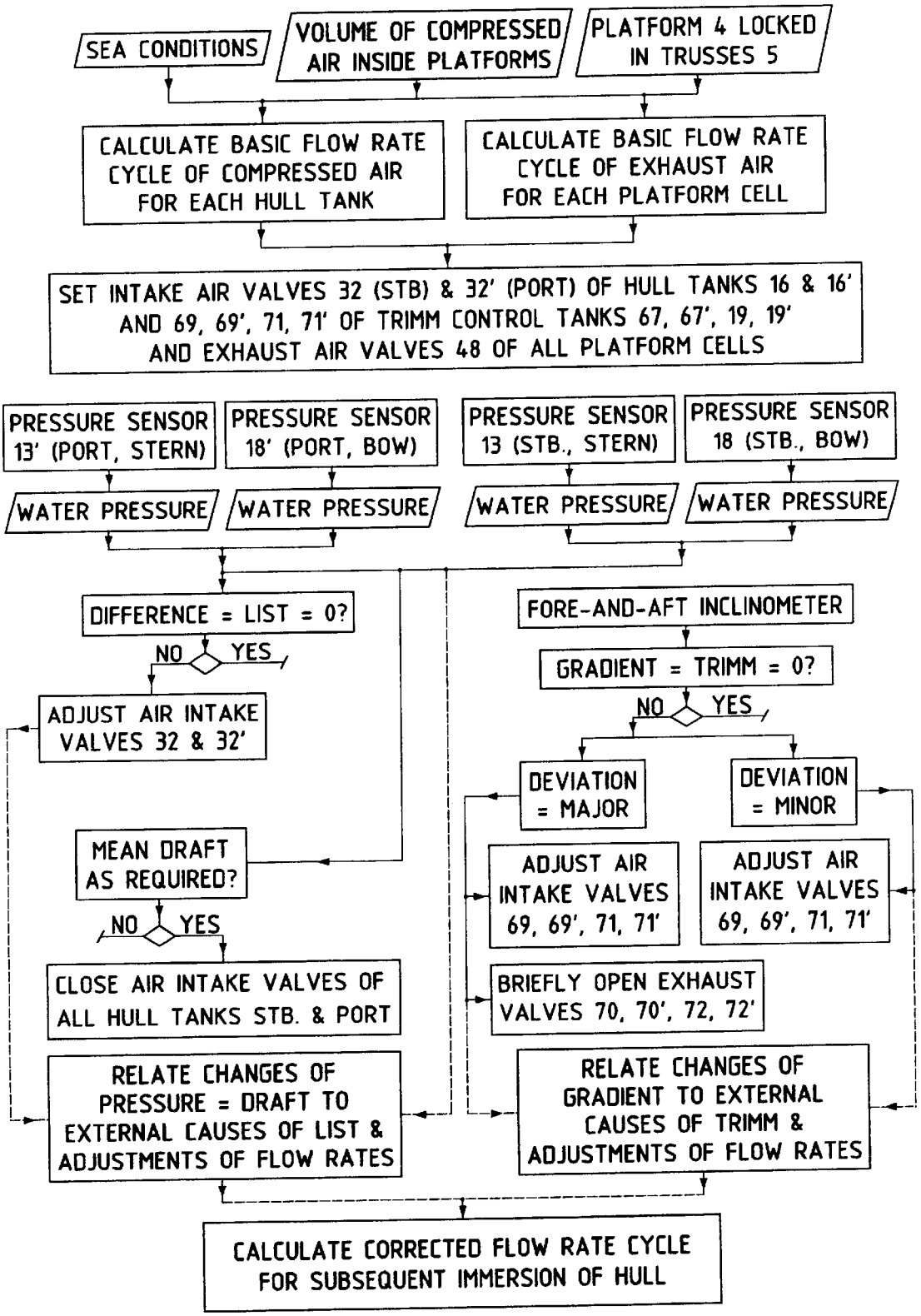

FIG. 10*b* shows the process flow of hulls 1 and 1' of ship 100 when re-emerging from loading draft to voyage draft while carrying the newly loaded submersible platforms 4, 4' and 4" that are now locked into two adjacent transverse trusses 5 and 5' of ship 100.

As shown on the top of FIG. 10*b*, the process starts with the calculation of the basic flow rate cycle of compressed air into each of hull tanks 16 and 16' and into the trimm control tanks 67 and 67' in the afterbody 15 and into the trim control tanks of 68 and 68' in the forebody 19, as well as of the flow rate of exhaust air from submersible platform cells 40, 40', 40" and 40'" of submersible platform 4 which parallels the rate at which compressed air is injected into hull tanks 16 and 16'. Constant components of the software for calculating the basic flow rate throughout the re-emergence of hulls 1 and 1' of ship 100 are the same as given for FIG. 10*a*. Current inputs are the sea conditions as in FIG. 10*a*, the volume of compressed air previously injected into submersible platform 4 for re-emerging (and recorded at that time), and the signal that submersible platform 4 is locked in place and ready for being lifted when the hulls 1 and 1' of the ship 100 re-emerge. Once the calculations are completed, air intake check valves 32 and 32' for compressed air of hull tanks 16 and 16', air intake check valves 69 and 69' of trimm control tanks 67 and 67' in the afterbody 15, air intake check valves 71 and 71' of trimm control tanks 68 and 68' in forebody 19, and exhaust air valves 48 of submersible platform cells 40, 40', 40" and 40'" are set according to the pre-planned cycle. This cycle defines the re-emergence of hulls 1 and 1' of ship 100 from loading draft to voyage draft and the resultant lifting of submersible platforms 4, 4' and 4" out of the water.

The next lower part of FIG. 10*b* shows in the left half the steps of the process for controlling list and in the right half the steps for controlling trimm of hulls 1 and 1' of the ship 100. Addressing the left half of this part of the diagram, list is present when the mean water pressure—i.e. depth—of the port side hull 1'measured by pressure sensors 13' and 18' differs from the mean water pressure measured by the pressure sensors 13 and 18 of the starboard hull 1. If list is not equal zero, the flow of compressed air into hull tanks 16 and 16' of the deeper—lagging—hulls 1 or 1' is increased by adjusting the related air intake check valve 32 or 32'.

The mean water pressure read by pressure sensors 13, 13', 18 and 18' is utilized for checking whether hulls 1 and 1' have attained voyage draft. When this is the case, compressed air intake check valves 32 and 32' of hull tanks 16 and 16' are closed.

The lower right half of FIG. 10*b* shows that trimm is controlled by a different method, i.e. not by measuring water pressure but by measuring the trimm gradient by means of a highly sensitive inclinometer. Any occurring trimm is counterbalanced by increasing the flow rate of compressed air into trimm control tanks 67 and 67' or 68 and 68' at the deeper end of hulls 1 and 1'. In case of a major deviation, the counter-balancing of trimm is accelerated by simultaneously releasing a blast of air from trimm control tanks 67 and 67' or trim control tanks 68 and 68' at the higher end of hulls 1 and 1'. When trimm equals zero, the basic flow rate of compressed air into trimm control tanks 67 and 67' or 68 and 68' remains as pre-calculated above.

All adjustments of the basic flow rate cycle are related to the recorded external causes, separate for list and trimm, as indicated by the shaded blocks at the bottom of FIG. 10*b*. After elimination of transitory external causes, the remaining validated adjustments are used for calculating the corrected flow rate cycle for exhaust valves 34 and 34' of all hull tanks 16 and 16' and of exhaust valves 70, 70', 72, 72' of the trimm control tanks 67, 67', 68 and 68' for the subsequent submerging of hulls 1 and 1' of ship 100 with the same load.

Figure 10C:
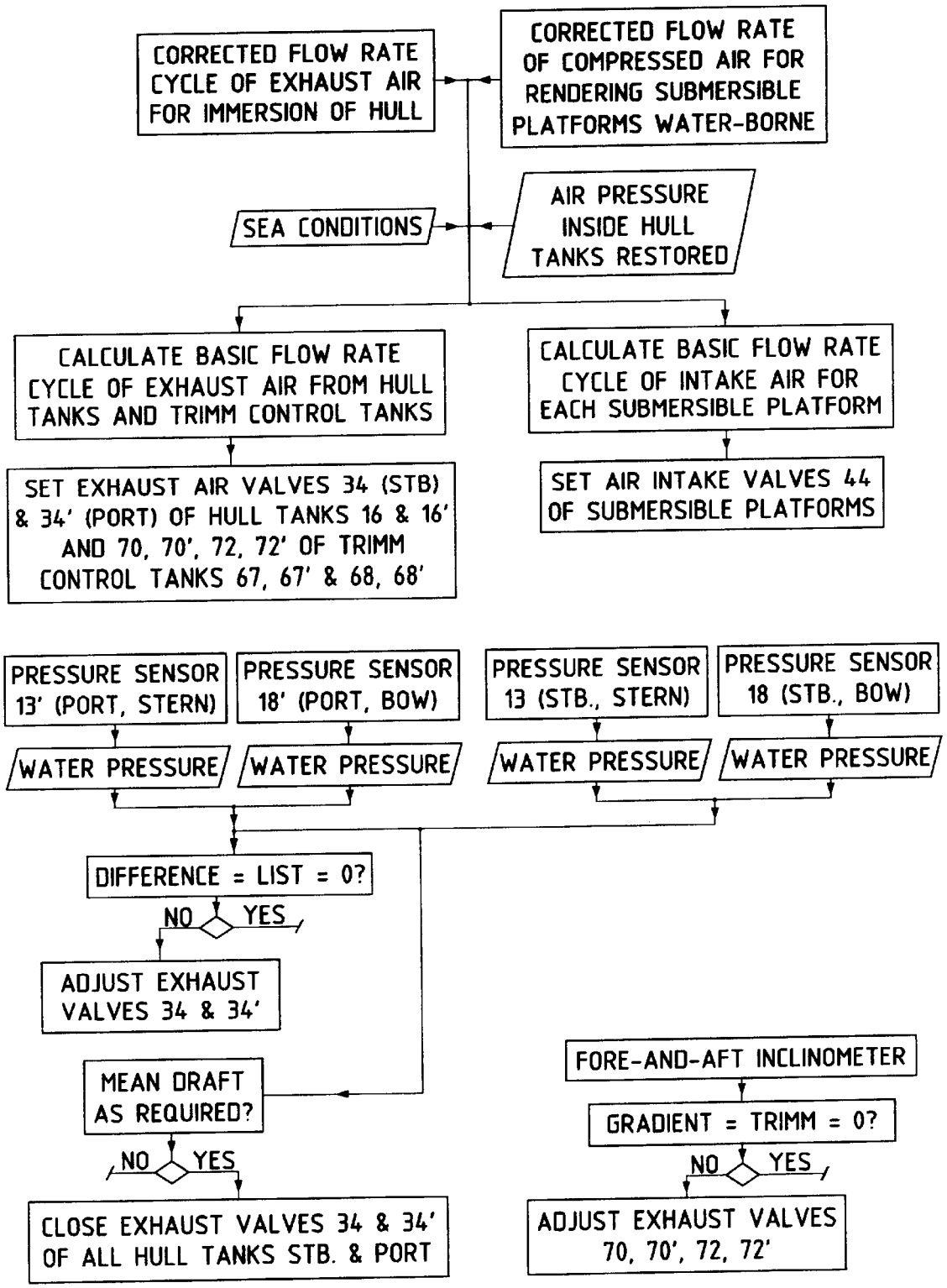

FIG. 10*c* shows the process flow of hulls 1 and 1' of ship 100 when rapidly immersing from voyage draft to loading draft at which submersible platforms 4, 4' and 4" with their now known burden have become water-borne and are no longer carried by hulls 1 and 1' of ship 100.

As shown at the top of FIG. 10*c*, the process starts with the calculation of the basic flow rate cycles of exhaust air from each of hull tanks 16 and 16' and from trimm control tanks 67 and 67' in afterbody 15 and from trimm control tanks 68 and 68' in forebody 19, and the calculation of the flow rate of compressed air into submersible platforms 4, 4' and 4" towards ensuring that submersible platform 4 will be water-borne when hulls 1 and 1' are at loading draft. Constant components of the software for calculating the basic flow rate of each valve throughout the immersion of hulls 1 and 1' of ship 100 are the same as given for FIG. 10*a*. Current inputs are the sea conditions, the now very accurate corrected flow rate cycle of exhaust air for immersion of hulls 1 and 1' and of the corrected flow rate cycle of compressed air for rendering submersible platforms 4, 4' and 4" water-borne when hulls 1 and 1' are at loading draft, both calculated and recorded during the preceding re-emergence of hulls 1 and 1', and, finally, the signal that the air pressure inside hull tanks 16 and 16' is restored to the reference pressure recorded at the end of the re-emergence of hulls 1 and 1' during the preceding re-emergence of hulls 1 and 1' from loading draft to voyage draft.

The lower half of FIG. 10*c* shows the process steps for controlling list, trimm and depth of immersion while hulls 1 and 1' quickly immerse to loading draft. List control is effected by measuring the mean draft of starboard hull 1 by means of pressure sensors 13 in afterbody 15 and pressure sensors 18 in forebody 19 and the mean draft of port hull 1' correspondingly. If list occurs, the flow rates of exhaust check valve 34 in starboard hull 1 and of exhaust valve 34' in port hull 1' are increased or decreased as required to counter-act list. If no list occurs, the calculated setting of exhaust check valves 34 and 34' is not changed.

The mean water pressure read by pressure sensors 13, 13', 18 and 18' is utilized for checking whether hulls 1 and 1' have attained loading draft. When this is the case, exhaust air check valves 34 and 34' of hull tanks 16 and 16' are closed.

The lower right half of FIG. 10*c* shows that trimm is controlled as shown in FIG. 10*b*, i.e., by measuring the trimm gradient by means of a highly sensitive inclinometer. Trimm is counterbalanced by increasing the flow rate of exhaust air from trimm control tanks 67 and 67' or 68 and 68' at the higher end of hulls 1 and 1'.

Acceleration of counter-balancing list or trimm by injecting compressed air into trimm control tanks 67 and 67' or 68 and 68' at the lower side or end of hulls 1 and 1' is not contemplated as the exhaust air flow rate cycles based on the corrected values gained during the preceding re-emergence are highly accurate, and as the process of immersion is very rapid and ends in self-stabilizing conditions when hulls 1 and 1' of ship 100 are at loading draft.

Figure 10D:
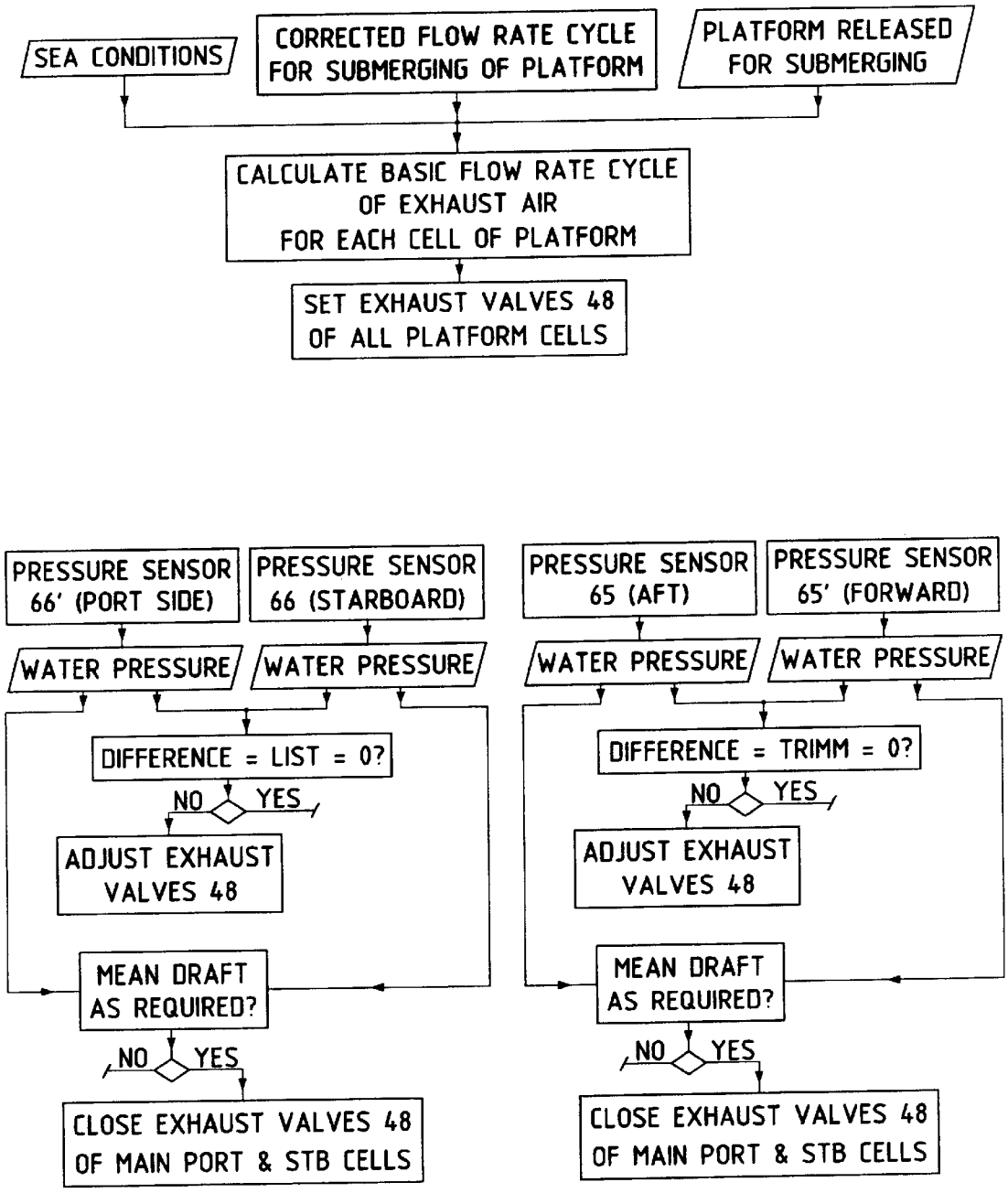

FIG. 10*d* shows the process flow of one of submersible platforms 4, 4' and 4" when being submerged with a known load of barges from its water-borne position to its deeply submerged position at which all floatable containers 12 are water-borne and the submersible platform 4 rest on top of the hulls 1 and 1' of ship 100.

The process starts with the calculation of the basic flow rate cycle of exhaust air from each of cells 40, 40', 40" and 40'" of submersible platform 4 throughout submerging, as shown at the top of FIG. 10*d*. Constant components of the software for calculating the basic flow rate are the same as defined for FIG. 10*a*. Current inputs are the actual sea conditions, the corrected flow rate cycles of all valves calculated and recorded after the preceding re-emergence of submersible platforms 4, 4' and 4" with their actual load of floatable containers 12, and the signal that all those submersible platforms 4, 4' and 4" which are to be submerged have been disengaged from their support system at transverse trusses 5, 5', 5" and 5'" of ship 100. Once the calculations are completed, air exhaust check valves 48 of each cell 40, 40' and 40''' are set, following a pre-planned cycle which lasts from submersible platforms 4, 4' and 4'' being water-borne and carrying floatable containers 12 to its deeply submerged position when floatable containers 12 are afloat and the submersible platforms 4, 4' and 4'' are seated on hulls 1 and 1' of ship 100.

The lower part of FIG. 10*d* shows in the left half the steps of the process for controlling list and in the right half the steps for controlling trimm of a typical submersible platform 4 of ship 100. The left half of the diagram shows that list measured by pressure sensors 66 and 66' is equalized by adjusting air exhaust check valves 48 at the high side of listing submersible platform 4 for increasing the flow rate of exhaust air. The right part of the FIG. 10*d* shows that trimm of submersible platform 4 indicated by pressure sensors 65 at its aft edge and pressure sensors 65' at its forward edge is controlled correspondingly by counter-acting increases of the flow of exhaust air through exhaust check valves 48 in cells 40''' at the aft edge or exhaust check valves 48 in cells 40' at the forward edge of submersible platform 4.

The mean water pressure read by pressure sensors 65, 65', 66, 66' is utilized for checking whether submersible platform 4 has attained the deeply submerged position on hulls 1' and 1' of ship 100. When this is the case, air exhaust check valves 48 of submersible platform 4 are closed and an evenly distributed volume of residual air remains inside cells 40, 40', 40'' and 40'''.

Acceleration of counter-balancing list or trimm by injecting compressed air into the cells 40, 40', 40'' or 40''' at the lower edge(s) of a tilting submersible platform 4 is not considered as the flow rate cycles of exhaust air based on the corrected values gained during the preceding re-emergence are highly accurate and as the process of submersion is very rapid and ends in self-stabilizing conditions for both the floatable containers 12 and the submersible platform 4.

The physical details of the process flow summarized in FIGS. 9 through 9*d* are defined below.

As outlined above in connection with FIGS. 10*a*, 10*b*, 10*c*, and 10*d*, pressure sensors 18 and 18' in forebody 19, and pressure sensors 13 and 13' in afterbody 15 monitor the level position of ship 100 transversal to its longitudinal axis. List is evident from hulls 1 and 1' having different draft. These differences are read by pressure sensors 13, 13', 18 and 18' as differences in water pressure. This information is fed back to the load computer which calculates the change in ballast condition required for neutralizing list. The load computer will then either set check valves 34 of piping systems branch line 33 for venting or set check valves 32 of piping system branch line 31 for blowing compressed into hull tank 16 for ejecting water. As presently configured, pressure sensors 13, 13', 18 and 18' are indeed sufficiently fast and accurate for monitoring draft and list of hulls 1 and 1'. However, these sensors 13, 13', 18 and 18' are not sufficiently fast and accurate to determine the direction of the "trim" (inclination in the direction of the longitudinal axis) of ship 100. Because of the great length of hulls 1 and 1', which are generally headed into the waves while floatable containers 12 are exchanged, pressures changes caused by widely spaced wave crests may be misinterpreted by the load computer. Thus, trim of hulls 1 and 1' is monitored by highly accurate, quick inclinometers similar to those which are used in mechanisms that keep barrels of naval guns in their pre-determined position despite the vessel's wave-induced motions. Such inclinometers are well known in the prior art.

FIG. 8*a* shows submersible platform 4 from below. Its actual depth is measured by reading water pressure at the bottom edge of its margin plating 52. Suitable pressure sensors 65 and 65' in the centerline 41 of ship 100 at the transverse margin plating 52, and sensors 66 and 66' in the middle of longitudinal margin plating 52 at the outboard edges of submersible platform 4 are arranged in pairs opposite to each other.

Pressure sensors 65, 65', 66, and 66' also monitor the level position of submersible platform 4. If pressure sensors 66 and 66' (which lie opposite to each other at longitudinal margin plating 52 of submersible platform 4) register list—i.e., inclination transversal to the longitudinal axis of ship—the size of the air cushions in cells 40 along its longitudinal edges is adjusted for neutralizing list. If pressure sensors 65 and 65' (which lie opposite to each other at transverse margin plating 52 of submersible platform 4) register trim—i.e., inclination parallel to the longitudinal axis of ship 100,—the air cushions in cells 40' and 40''' along its forward and rear edges at both sides of centerline 41 are adjusted for neutralizing trim.

The load computer controls the position of hulls 1 and 1' and submersible platforms 4 regarding draft and level position by setting remote-controlled check valves 32, 32', 34 and 34' for selectively venting air. For this purpose, the load computer contains a control profile for the check valve of each cell 40, 40', 40'' and 40''' of submersible platform 4 or, respectively, of each hull tank 16 and 16'. Calculated before ship 100 immerses or re-emerges, these control profiles continuously regulate check valves 32, 32', 34 and 34' while the hulls 1 and 1' and submersible platforms 4 increase or decrease draft. Based on the planned draft programmed in the control profile and the feed-back on actual draft from pressure sensors 13, 13', 18, 18', 65, 65', 66, and 66', the load computer continuously compares the planned versus actual positions of hulls 1 and 1' and submersible platforms 4, and incorporates necessary corrections.

The control profile is a file of control signals for continuously setting each check valve 32, 32', 34 and 34' for the appropriate flow of air while hulls 1 and 1' and submersible platforms 4 immerse or re-emerge. The control profile is generated by special software in the load computer in bridge 8 of ship 100. This software contains the hydrostatic data of ship 100, e.g., its characteristic interdependence of carrying capacity, stability, draft and the required volume of and pressure in air cushions inside ballast hull tanks 16 of hulls 1 and 1' and inside cells 40, 40', 40'', and 40''' of submersible platforms 4. Prior to ship 100 re-emerging with newly laden submersible platforms 4, this software is used to calculate the control profiles for the specific loading condition based on the hydrostatic data of ship 100 and data on weight, draft, dimensions, centers of gravity of to-be-loaded floatable containers 12, and on their arrangement on submersible platforms 4.

When hulls 1 and 1' and submersible platforms 4 immerse and re-emerge, their actual position may deviate from the planned position programmed in the control profiles, e.g., if the weights of floatable containers 12 or their arrangement on deck 37 of submersible platforms 4 do not correspond with the premises made for calculating the control profiles. Accordingly, the continuous comparison of planned vs. actual position of hulls 1 and 1' and submersible platforms 4 may require correction of the control profiles of the assigned check valves. Adjustments of the control profile recorded when ship 100 re-emerges are re-calculated by the load computer for the subsequent immersion of ship 100 and incorporated into the corresponding control profiles. For immersing—which is more than twice as fast as re-emerging—the control profiles are, thus, highly accurate so that any further adjustments of check valves 32, 32', 34 and 34' would be small and can be effected rapidly, or would not be necessary at all.

Immersion and re-emergence of hulls 1 and 1' and submersible platforms 4 are short, transient processes for which the referenced control and monitoring systems suffice. However, the time span of a voyage during which ship 100 floats on air cushions inside hull tanks 16 is considerably longer. During this time, minor leakage of check valves 32 and 34 of piping systems 31 and 33 could lead to—generally small—losses of air from hull tanks 16. When subsequently ship 100 prepares for immersing and shut-off valves 30 in the bottom of hull tanks 16 are opened, water would flow into hull tanks 16 and equalize the loss of air. This would change the actual conditions in the hull tanks 16 from those assumed for calculating the control profiles for the check valves. For eliminating any potential risk, each hull tank 16 is equipped with a sensor for checking its internal air pressure. If the air pressure before the immersion of ship 100 would be lower than the pressure of the air cushion on which ship 100 had previously re-emerged, the control profiles cause compressed air to be blown into hull tanks 16 until the original air pressure is restored.

Up to this point, the interconnections of ship 100 have been shown and a brief synopsis of the operation thereof described. However, the present invention may be best described through the use of examples. Thus, it will be provided below an example of ship 100 rising from loading draft to voyage draft and immersing from voyage draft to loading draft. First, a broad understanding of the method of the present invention will be further described.

The method of the present invention is for the rapid adjustment of the position of hulls 1 and 1 and submersible platforms 4 regarding both draft as well as inclination in the longitudinal axis ("trim") and transversal axis ("list") of ship 100 while rapidly increasing and decreasing its draft. This process is independent of the much slower system which controls trim and list of ship 100 during a voyage and needs to compensate, for instance, the shift of the center of gravity of ship 100 caused by the consumption of fuel during voyage. The later system (i.e., adjusting for trim and list during voyage) is known in the art and is not the object of this invention. When ship 100 floats at voyage draft, the weight of the submersible platforms 4, which are loaded with floatable containers 12, is borne by hulls 1 and 1'. However, when ship 100 is immersed to loading draft and the submersible platforms 4 in cargo space 24 are waterborne, the total weight of submersible platforms 4 and floatable containers 12 parked on them, is borne solely by submersible platforms 4. The load is shifted from hulls 1 and 1' to the submersible platforms 4 when ship 100 immerses. Conversely, when ship 100 re-emerges, the buoyancy of hulls 1 and 1' and submersible platforms 4 is constantly adjusted by controlling the size of the air cushions inside hull tank 16 and inside cells 40 of submersible platform 4.

Submersible platform 4 of ship 100 is designed to float with its deck 37 at a pre-determined height above the water—"freeboard"—when submersible platform 4 is waterborne on an air cushion at an internal pressure that is equal to the water pressure at the bottom of submersible platform 4. Hence, the surface of the water inside the submersible platform 4 below the air cushion is level with the bottom of submersible platform 4. In other words, the air cushion completely takes up the volume encompassed by watertight margin plating 52 below deck 37 of submersible platform 4. On an air cushion of this volume, submersible platform 4 floats at the pre-determined free board when carrying its full load of floatable containers 12.

Before ship 100 immerses from voyage draft to loading draft, submersible platforms 4 rest above the water surface on supports at transverse trusses 5 that connect the ship 100 hulls 1 and 1'. When submersible platform 4 has gone down with the immersing ship 100 to the point where its margin plating 52 enters the water surface, air is captured inside the space encompassed by its deck 37 and margin plating 52. When ship 100 immerses farther to loading draft, submersible platform 4 also sinks deeper. As water pressure increases with depth, the captured air is compressed, and the volume it takes up in submersible platform 4 decreases. Thus, the surface of the water below such an air cushion inside submersible platform 4 lies above the level of the lower edge of the margin plating 52. Thus, the captured air does not fully take up the volume within margin plating 52 and deck 37 of submersible platform 4. Hence, on a "meager" air cushion, which contains only the ambient air captured when submersible platform 4 became waterborne with immersing ship 100, the submersible platform 4 does not attain its full carrying capacity.

Before ship 100 immerses, transverse trusses 5 carry the total weight of submersible platform 4. When submersible platform 4 enters the water with the immersing ship 100 as described above, the air cushion captured inside it creates buoyancy and begins to carry submersible platform 4. When this buoyancy has become equal to its total weight, submersible platform 4 floats at the then prevailing freeboard and no longer sinks deeper when ship 100 continues to immerse to loading draft. If said freeboard begins to exceed the freeboard required for engaging submersible platform 4 on its supports when ship 100 subsequently re-emerges, submersible platform 4 is vented until it floats at the required freeboard. However, if, after sinking into the water with immersing ship 100, submersible platform 4 containing a meager air cushion floats at less than the required freeboard, or if it is so heavily laden that it would remain on its supports when ship 100 is immersed to loading draft, compressed air is blown into the submersible platform 4 until it floats at the required freeboard. The draft—and thus, the freeboard—at which submersible platform 4 becomes waterborne, is calculated by a load computer, and venting or injecting air is regulated correspondingly. The control processes for adjusting the freeboard of the submersible platform 4 begin before ship 100 is fully immersed to loading draft and are finished when it attains loading draft.

While submerging or re-emerging, the horizontal position of submersible platforms 4 is adjusted by venting or filling up air cushions in selected cells 40, 40', 40" and 40'" of the submersible platform 4. When not carrying a load, submersible platform 4 floats in level position on an air cushion of constant thickness due to its symmetrical structure and, thus, its symmetrically distributed weight. However, a submersible platform 4 usually carries several floatable containers 12 of different sizes so that their weights burden submersible platform 4 asymmetrically. Whereas an empty submersible platform 4 will float in level position on an air cushion of constant thickness, the submersible platform 4 would tilt under an asymmetrical load. In order to prevent tilting, the cells 40, 40', 40" and 40'" of submersible platforms 4 are selectively vented—or blown with compressed air, respectively—so that the center of all buoyancy forces of the air cushions in the cells coincides with the common center of gravity of all floatable containers 12. Hence, in a submersible platform 4 carrying floatable containers and floating in level position, the air cushions in its cells 40 differ in size.

The extent to which a submersible platform 4 is burdened by an array of floatable containers 12 changes while the submersible platform 4 submerges or re-surfaces. When it submerges from its level waterborne position and sinks farther below water, floatable containers 12 of different weight become waterborne one after another at different draft. This changes the weight that remains on the submersible platform 4 asymmetrically so that the size of the air cushions in the submersible platform 4 cells must be adjusted continuously so that their common center of buoyancy coincides with the center of gravity of the floatable containers 12 that remain on the submersible platform 4.

Correspondingly, when submersible platform 4 rises from its deeply submerged position and floating containers 12 of different draft land on its deck 37 one after another, the size of air cushions in cells 40 must be adjusted continuously. Thus, compressed air is blown into cells 40 selectively until deck 37 of the submersible platform 4 has surfaced, i.e., until it carries the full weight of all floatable containers 12. From then on, the burden on the floating submersible platform 4 is increased only by the weight of its emerging structure. As this is symmetrical, the resulting burden is symmetrical. Thus, the air cushions inside submersible platform 4 are increased uniformly until it floats at the required freeboard.

When ship 100 re-emerges to voyage draft, submersible platform 4 is engaged by supports at the transverse trusses 5 and lifted from the water. While the weight of submersible platform 4 is being transferred progressively to transverse trusses 5, its air cushions are correspondingly unburdened. Thus, the air cushions are decompressed, and the water level inside cells 40 drops gradually as long as the bottom edges of submersible platform 4 remain immersed. Hence, in cells 40 containing only a small air cushion, negative pressure can occur, i.e., when the submersible platform 4 is lifted by hulls 1 and 1', such cells 40 act like siphons and suck in water. Of course, the air cushions in hull tanks 16 are sufficiently buoyant to lift the added load. But when a submersible platform 4 has sucked in water and this is released instantaneously with the bottom edge of its margin plating surfaces 52, destructive water hammer may occur. In a submersible platform 4 being lifted by ship 100, water hammer is prevented by opening check valve 48 in vent lines 47 of these cells 40 when their (calculated) internal pressure is about equal to atmospheric pressure so that from then on ambient air flows freely into these cells 40.

Conversely, when a submersible platform 4 is lifted up by emerging ship 100 and its cells 40 contain air cushions that completely fill them when submerged to maximal depth, cells 40 will blow off air because the expanding air cushion's volume exceeds the volume of cell 40. Such excess air is blown off freely along the bottom edge of margin plating 52. Countermeasures to prevent this phenomenon are not required.

The above description explains the process of a submersible platform 4 submerging and re-emerging for the exchange of floatable containers 12. However, ship 100 does not always exchange floatable containers 12 on all of its submersible platforms 4.

In a submersible platform 4 which is not to be submerged for exchanging floatable containers 12, check valves 48 for venting this submersible platform 4 are opened before ship 100 immerses from voyage draft to loading draft, so that no air is captured inside its cells 40, 40', 40" and 40'" when it sinks into the water with the immersing ship 100. Such a vented submersible platform 4 will not become waterborne but remain on its supports at the transverse trusses 5 when ship 100 is at loading draft. In this position, submersible platform 4 only displaces water equivalent to the volume of its components that submerge when ship 100 immerses. This volume is negligibly small so that in cargo space 24 in which the submersible platform 4 does not become waterborne, buoyancy need not be transferred from hull tanks 1 and 1' to cells 40, 40', 40" and 40'".

The conditions described above for submersible platforms 4 similarly apply to immersing or re-emerging hulls 1 and 1'. For instance, when lifting floating submersible platform 4 out of the water, hulls 1 and 1' are burdened asymmetrically transversal to their longitudinal axis. As shown above, the submersible platforms 4 are level when they float at the programmed freeboard on appropriately sized air cushions. However, when the submersible platform 4 are lifted out of the water by ship 100, the water surface inside cells 40 below the air cushion recedes and the air cushion's internal pressure and buoyancy are reduced. Generally, these air cushions are of different sizes and arranged asymmetrically to suit the weight of floatable containers 12. As emerging ship 100 lifts the submersible platforms 4 in level position, the air cushions expand uniformly so that the original asymmetry of the load is restored and affects hulls 1 and 1', i.e., they are unburdened asymmetrically. This asymmetrical unburdening of hulls 1 and 1' is counterbalanced by selectively injecting air into individual hull tanks 16. As the loads on individual submersible platforms 4 generally differ, hulls 1 and 1' are also burdened asymmetrically in longitudinal direction. Correspondingly, throughout all phases of immersion or re-emergence, hulls 1 and 1' are held in level position by selectively venting or injection air hull tanks 16.

The phases of ship 100 immersing to loading draft and re-emerging to voyage draft are described in detail below. Since data for controlling draft and level position of the immersing ship 100 are obtained when it re-emerges with newly loaded floatable containers, the latter case is presented first.

Rising from Loading Draft to Voyage Draft

Ship 100 is at loading draft for the exchange of floatable containers 12. Submersible platforms 4 are deeply submerged and rest on hulls 1 and 1'. Above them, several floatable containers 12 of different length, breadth and draft are moored to transverse trusses 5. They are arranged between adjacent transverse trusses 5 towards burdening submersible platforms 4 as nearly symmetrically as possible when afloat and carry floatable containers 12.

Forebody 19 and afterbody 15 float on the buoyancy of their hulls. Forecastle 6 and poop 7 are waterborne and primarily stabilize ship 100 in the direction of its longitudinal and transversal axes.

Phase A1

Ship 100 floats at loading draft on air cushions in hull tanks 16, in forebody 19 and in afterbody 15. Submersible platforms 4 rest fully submerged on hulls 1 and 1'.

Hull Tanks 16

Check valves 32 of piping systems 31 for injecting air and check valves 34 of piping systems 33 for venting hull tanks 16 are closed, shut-off valves 30 in the bottoms of hull tanks 16 are open. Hull tanks 16 contain air cushions above the surface of water ballast that had been taken in when ship 100 immersed.

Submersible Platforms 4

Fully submerged, submersible platform 4 rest with two supports on each of hulls 1 and 1'. Check valves 44 of piping systems 43 for injecting compressed air and check valves 48 of piping systems 47 for venting submersible platforms 4 are closed. Cells 40, 40', 40" and 40'" in submersible platforms 4 contain residual air whose total buoyancy is smaller than the weight of the submersible platform 4.

Phase A2

Ship 100 floats at loading draft on air cushions in hull tanks 16, in forebody 19 and in afterbody 15. Compressed air is blown into submersible platforms 4 so that they rise. This phase ends when each of submersible platforms 4 contacts the bottom of the first of floatable containers 12 floating above it.

Hull Tanks 16

The state of hull tanks 16 remains constant throughout this phase.

Submersible Platforms 4

Check valves 44 of piping systems 43 are opened so that compressed air flows uniformly into cells 40, 40', 40" and 40'" of submersible platform 4. When the buoyancy of the air cushions in its cells exceeds the weight of submersible platform 4, it rises in level position until deck 37 contacts the bottom of the floatable container 12 with the deepest draft.

Phase A3

Ship 100 floats at loading draft on air cushions in hull tanks 16, in forebody 19 and in afterbody 15. Submersible platforms 4 continue to rise until they carry all floatable containers 12. Injecting compressed air is continued until, at the end of this phase, decks 37 of submersible platforms 4 are even with the water surface.

Hull Tanks 16

The state of hull tanks 16 remains constant throughout this phase.

Submersible Platforms 4

For compensating the asymmetrical burden on submersible platforms 4, check valves 44 of piping systems 43 are set for selectively blowing compressed air into cells 40, 40', 40", 40'".

While submersible platforms 4 rise, the level position parallel to their longitudinal and transversal axes is monitored by pressure sensors 65, 65', 66 and 66' at margin plating 52 which continuously compare planned vs. actual draft. If submersible platforms 4 deviate from the level position, the flow of compressed air into cells 40, 40', 40" and 40'" located at the perimeter of submersible platform 4 is decreased or increased as required for neutralizing the deviation.

Phase A4

Ship 100 floats at loading draft on air cushions in hull tanks 16, in forebody 19 and in afterbody 15. Submersible platforms 4 rise above the water surface 21 at loading draft until, at the end of this phase, they are waterborne at the programmed freeboard, at which point support rails 58 are extended from transverse trusses 5.

Hull Tanks 16

The state of hull tanks 16 remains constant throughout this phase.

Submersible Platforms 4

Decks 37 of submersible platforms 4 are level with the water surface 21 and carry all floatable containers 12. When rising higher, their burden on submersible platforms 4 is no longer increased asymmetrically. Thus, check valves 44 of piping systems 43 are set for increasing the air cushions inside cells 40, 40', 40" and 40'" uniformly until submersible platforms 4 float at the programmed freeboard.

The transversal and longitudinal level position of submersible platforms 4 is being monitored throughout this phase. When submersible platforms 4 attain the programmed freeboard, the supply of compressed air is shut off by check valves 44 of piping systems 43.

In this position, tilting support rails 58 are extended from transverse trusses 5, as shown and discussed in FIG. 7, so that top rails 59 butt against margin plating 52 of submersible platform 4 so that they engage its bearing bars 60 when ship 100 subsequently re-emerges to voyage draft.

Phase A5

Submersible platforms 4 are waterborne at the programmed freeboard. Ship 100 begins to re-emerge, lifting submersible platforms 4 until, at the end of this phase, the bottom edge of their margin plating 52 breaks the water surface so that the air cushions in cells 40, 40', 40" and 40'" escape and the weight of all submersible platforms 4 is borne by hulls 1 and 1'.

Hull Tanks 16

For re-emerging from loading draft to voyage draft, check valves 32 of piping systems 31 are opened and compressed air is injected into hull tanks 16.

After ship 100 has risen fractions of a meter above the water surface at loading draft 21, top rails 59 having been extended from transverse trusses 5 touch bearing bars 60 of the submersible platforms 4. While ship 100 continues to re-emerge, the weight of submersible platforms 4 is gradually transferred via bearing rail 57 to transverse trusses 5. As ship 100 had floated in level position when at loading draft, and as the added buoyancy for re-emerging must be distributed symmetrically, air cushions of uniform thickness are blown into hull tanks 16 up to this point.

Ship 100 continues to re-emerge and the bottom edge of submersible platforms 4 breaks the surface. At this point, the air cushions in cells 40, 40', 40" and 40'" escape into the atmosphere and the full weight of the submersible platforms 4 is borne by hulls 1 and 1'. Without the buoyancy contributed by air cushions that had been blown selectively into cells 40, 40', 40" and 40'" for counterbalancing the asymmetrical burden of floatable containers 12, the burden transferred from submersible platform 4 to hulls 1 and 1' is asymmetrical. Accordingly, compressed air is blown selectively into hull tanks 16 from this point on.

Submersible Platforms 4

While ship 100 continues to re-emerge, submersible platforms 4 are lifted progressively out of the water. Their weight is gradually transferred to ship 100, and the air cushions inside expand. If submersible platforms 4 have risen so far that the pressure of the air cushion inside one of the cells 40, 40', 40" and 40'", as calculated, has dropped to atmospheric pressure, check valves 48 of piping systems 47 for venting are opened so that ambient air flows freely into this cell and no negative pressure builds up when submersible platform 4 is lifted higher out of the water by re-emerging ship 100.

Forebody 19 and Afterbody 15

While ship 100 is re-emerging, water is pumped from ballast tanks in forebody 19 and afterbody 15 according to a separate control system, so that the system for regulating draft and level position of hulls 1 and 1' and submersible platforms 4 in cargo spaces 24 is not affected by the buoyancy of forebody 19 and afterbody 15. However, all ballast systems of ship 100 permit controlled deviation from this procedure, i.e., ship 100 can also re-emerge from loading draft to voyage draft by first decreasing draft of forebody 19 and subsequently bringing up afterbody 15, or conversely, immerse in the corresponding manner.

Phase A6

Ship 100 continues to re-emerge until, at the end of this phase, it is at voyage draft and submersible platforms 4, forecastle 6 and poop 7 are several meters above water.

Hull Tanks 16

Compressed air is continued to be blown selectively into hull tanks 16. Shortly before ship 100 attains voyage draft, check valves 32 of piping systems 31 are gradually closed and progressively shut down the flow of compressed air into hull tanks 16 so that ship 100 does not overshoot voyage draft. When ship 100 is at voyage draft, shut-off valves 30 in the bottom of hull tanks 16 are closed automatically.

Submersible Platforms 4

Submersible platforms 4 rest with bearing bars 60 on top rails 59 which transfer their weight through support rails 58 and bearing rails 57 to transverse trusses 5, as shown and discussed in FIG. 7.

At the end of this phase, ship 100 is at voyage draft, ready to continue its voyage.

Immersing from Voyage Draft to Loading Draft

Preparatory to ship 100 immersing to loading draft, check valves 48 of piping systems 47 for venting are opened in those submersible platforms 4 which are not to be submerged for exchanging floatable containers 12. Hence, these submersible platforms 4 do not capture an air cushion when they sink into the water with immersing ship 100. When ship 100 is at loading draft, these submersible platforms 4 rest on their supports at transverse trusses 5 with their decks 37 above the water surface.

In those submersible platforms 4 which are to be submerged for the exchange of floatable containers 12, check valves 48 of piping systems 47 for venting are closed prior to immersion of ship 100. The following description applies exclusively to those submersible platforms 4 which are to be submerged.

Preparations for immersion are wrapped up by checking air pressure inside hull tanks 16. If lower than recorded at the end of the preceding immersion, original pressure is restored by injecting compressed air. Finally, shut-off valves 30 in the bottom of hull tanks 16 are opened.

Phase B1

Ship 100 is at voyage draft, shut-off valves 30 in hull tanks 16 are open. Submersible platforms 4, forecastle 6 and poop 7 sit several meters above water.

Hull Tanks 16

Ship 100 floats on air cushions in hull tanks 16 which carry its weight and that of all floatable containers 12 on submersible platforms 4. Below the air cushions, hull tanks 16 contain water. In a cargo space 24 with a submersible platform 4 laden to full capacity, air cushions in hull tanks 16 are large and the residual volume of water is small, whereas in a cargo space 24 with a lightly laden submersible platform 4 the ratio of air vs. water is reversed.

Submersible Platforms 4

With check valves 48 of piping system 47 closed, submersible platforms 4 sit above water surface 20 at voyage draft.

Forebody 19 and Afterbody 15

Forecastle 6 and poop 7 sit above water surface 20 at voyage draft.

Phase B2

Ship 100 begins to immerse, and submersible platforms 4, forecastle 6 and poop 7 go down with it. At the end of this phase, ship 100 is immersed so far that the lower edges of submersible platforms 4 and the bottoms of forecastle 6 and poop 7 contact the water surface.

Hull Tanks 16

Below those submersible platforms 4 which are to be submerged, check valves 34 of piping systems 33 are set for venting hull tanks 16 uniformly so that hulls 1 and 1' remain in level position while immersing.

Submersible Platforms 4

With check valves 48 of piping systems 47 for venting closed, submersible platforms 4 rest on transverse trusses 5. As ship 100 immerses, submersible platforms 4 sink lower with it until the volume encompassed by deck 37 and margin plating 52 is closed off at the bottom by the water surface.

Forebody 19 and Afterbody 15

By flooding ballast tanks 16 and 16', the buoyancy of forebody 19 and afterbody 15 is adjusted in such manner that they do not affect the system that controls the immersion of hulls 1 and 1' in cargo spaces 24 while ship 100 immerses.

Phase B3

While ship 100 continues to immerse, the undersides of submersible platforms 4 and the bottoms of forecastle 6 and poop 7 sink below the water surface. Thus, air cushions are built up inside submersible platforms 4. At the end of this phase, ship 100 is at loading draft and submersible platforms 4 are waterborne at there programmed freeboard.

Hull Tanks 16

Hulls 1 and 1' continue to be vented and immerse deeper. As water pressure rises with depth, internal pressure of the air cushions in hull tanks 16 rises and their volume decreases.

Check valves 34 of piping systems 33 are set for venting hull tanks 16 selectively, as during this phase the buoyancy of submersible platforms 4 increases which reduces the load borne by hulls 1 and 1' asymmetrically. Asymmetrical loading parallel to the longitudinal axis of ship 100 results from differences in the total weights of submersible platforms 4, transversal thereto from the asymmetrical arrangement of floatable containers 12 on submersible platforms 4.

In order to allow for the inertia of the (large) check valves 34 of piping system 33, venting of hull tanks 16 is gradually decreased and, thus, the rate of immersion of ship 100 is progressively retarded in order to slowly approach and not undershoot loading draft. When ship 100 attains loading draft, check valves 34 of piping system 33 are closed automatically.

Submersible Platforms 4

As submersible platforms 4 sink lower with ship 100, the bottom edge of their margin plating 52 submerges. With check valves 48 of piping systems 47 closed, (meager) air cushions are built up in them. Check valves 48 of piping systems 47, or check valves 44 of piping systems 43 respectively, are set for venting or injecting air selectively, as required for submersible platforms 4 to float at programmed freeboard when ship 100 is at loading draft.

Forebody 19 and Afterbody 15

The lowest watertight deck 22 in forecastle 6 and the lowest watertight deck 25 in poop 7 are level with the water surface at loading draft 21 and stabilize immersed ship 100.

Phase B4

Ship 100 is at loading draft. While submersible platforms 4 submerge, floatable containers 12 on their decks 37 immerse and become waterborne one after another. This phase ends when the first floatable containers 12 float off decks 37 of submersible platforms 4 while the latter continue to sink.

Hull Tanks 16

The state of hull tanks 16 remains constant throughout this phase.

Submersible Platforms 4

Prior to submerging, submersible platforms 4 float at programmed freeboard. Their bearing bars 60 are above top rails 59 at transverse trusses 5. After top rails 59 have been retracted by actuators 61 as described in context with FIG. 7, the clear opening between top rails 59 is wide enough for the immersing submersible platform 4 to pass through.

Check valves 48 of piping systems 47 are set for venting cells 40, 40', 40" and 40'" of submersible platforms 4. While they submerge deeper, their level position is maintained by uniform venting. As soon as their deck 37 is awash, floatable containers 12 on top begin to immerse and gain buoyancy. Due to generally being arranged asymmetrically, the immersing floatable containers 12 unburden submersible platforms 4 asymmetrically. Accordingly, check valves 48 of piping systems 47 are set for venting submersible platforms 4 selectively so that they continue to submerge in level position until on each of them the floatable container 12 with the deepest draft as the last one lifts off deck 37.

Forebody 19 and Afterbody 15

The state of forebody 19 and afterbody 15 remains constant throughout this phase.

Phase B5

Ship 100 is at loading draft. Submersible platforms 4 have submerged to a depth at which all floatable containers 12 are waterborne while the unburdened submersible platforms 4 continue to sink deeper. This phase ends when, in their deep position, submersible platforms 4 rest on top of hulls 1 and 1'.

Hull Tanks 16

During this phase, the position of hull tanks 16 remains constant until submersible platforms 4 are seated on hulls 1 and 1' and the latter carry their weight. This weight is borne by hulls 1 and 1' in their full length between forebody 19 and afterbody 15. Because of the large volume of hulls 1 and 1', the relatively small residual weight of submersible platforms 4 causes hulls 1 and 1' to sink very slightly below the programmed loading draft, which is tolerated without correction.

Submersible Platforms 4

After the last floatable container 12 has floated up from deck 37, submersible platforms 4 are continued to be vented and submerge deeper. Due to the symmetrical load of their structural weight, check valves 48 of piping systems 47 are set for venting air cushions in cells 40, 40', 40" and 40'" uniformly in order to maintain the level position of submersible platforms 4 until they land on hulls 1 and 1'.

At a programmed distance before submersible platforms 4 land on hulls 1 and 1', check valves 48 of piping systems 47 are gradually closed and progressively reduce venting for a soft landing of submersible platforms 4 on hulls 1 and 1' in spite of the inevitable inertia of the (large) valves. Check valves 48 of piping systems 47 are closed automatically when, with a residual volume of air inside, submersible platforms 4 rest on hulls 1 and 1'. This residual air cushion is programmed to reduce the burden on hulls 1 and 1' imposed by submersible platforms 4 to less than their structural weight.

Forebody 19 and Afterbody 15

Due to being burdened by submersible platforms 4, hulls 1 and 1' in forebody 19 and afterbody 15 are immersed slightly below loading draft. However, this negligibly small deviation is not corrected.

At the end of this phase, ship 100 is ready for the exchange of waterborne floatable containers 12 against other ones.

It will be apparent from the foregoing description that the present invention provides a new method and apparatus for loading and unloading cargo from a twin-hull ship that is particularly effective in short-sea transport. While a specific embodiment of providing the venting or insertion of air has been provided, countless variations may be utilized. For instance, it is foreseen that the same valves could be used for both inserting and venting air into the hull tanks and under the submersible platforms. Moreover, varying numbers of submersible platforms and respective transverse trusses are possible.

While there has been shown and described what is presently considered to be the preferred embodiment of this invention, it will be obvious to those skilled in the art that various changes and modifications may be made without departing from the broader aspects of this invention. For instance, although the invention has been described in conjunction with a TSL, it is equally applicable to other types of other multi-hull ships. Moreover, although the submersible platforms that have been shown are advantageously open on both ends to permit simultaneous loading and unloading, it is feasible that the submersible platforms could have only one open end.

It is, therefore, aimed in the appended claims to cover all such changes and modifications as fall within the true scope and spirit of the invention.

I claim:

1. A method of loading cargo packed in at least one floatable container onto a seaworthy vessel comprising:

(i) first and second substantially parallel hulls which lie beneath the water surface;

(ii) first and second hull tanks for regulating the draft and horizontal position of said vessel wherein when said hull tanks are substantially filled with water said vessel is at a loading draft and when said hull tanks are substantially filled with air said vessel is at voyage draft;

(iii) a generally horizontal submersible platform;

(iv) a bearing bar projecting from said platform;

(v) a transverse truss coupled between said first and second hulls and generally perpendicular to said platform;

(vi) a support rail on said transverse truss for engaging said bearing bar and supporting said platform;

(vii) an air cell, subdivided longitudinally and transversely, beneath said platform;

(viii) a first air compressor;

(ix) first piping means for injecting air from said first air compressor into said air cell;

(x) a first valve which regulates the flow of air from said first air compressor into said air cell;

(xi) first vent piping means for ejecting air from said air cell;

(xii) a second valve which regulates the venting of air from said air cell;

(xiii) a second air compressor;

(xiv) second piping means for injecting air from said second air compressor into said hull tanks;

(xv) a third valve which regulates the flow of air from said second air compressor into said hull tanks;

(xvi) second vent piping means for ejecting air from said hull tanks;

(xvii) a fourth valve which regulates the venting of air from said hull tanks;

(xviii) a first plurality of sensors mounted on said platform providing feed-back on depth of immersion and horizontal position of said platform to said central processor;

(xix) a second plurality of sensors mounted on said hulls providing feed-back on depth of immersion and horizontal position of said hulls to said central processor; and (xx) a central processor including calculated flow rates for setting said first and third valves which regulate the flows of compressed air from said air compressors to said air cell and said hull tanks, respectively, and the calculated flow rates for said second and fourth valves which regulate the flows of air vented from said air cell and said hull tanks, respectively, wherein said method comprises the steps of:

(a) submersing said platform beneath the water surface level wherein said platform is supported on said hulls when said vessel is at said loading draft;

(b) floating said cargo above said platform;

(c) injecting air from said first air compressor through said first piping means at a first calculated flow rate by said first valve until said platform first engages said cargo;

(d) injecting air from said first air compressor through said first piping means at a second calculated flow rate by said first valve until said platform rises until it is at water level;

(e) injecting air from said first air compressor through said first piping means at a third calculated flow rate by said first valve until platform is at a programmed freeboard level;

(f) extending said support rail to engage said bearing bar; and (g) injecting air from said second air compressor through said second piping means until said vessel is at voyage draft.

2. The method of claim 1 wherein said first calculated flow rate of injected air, said second calculated flow rate of injected air, and said third calculated flow rate of injected air are the same.

3. A method of discharging cargo packed in at least one floatable container from a seaworthy vessel comprising:

(i) first and second substantially parallel hulls which lie beneath the water surface;

(ii) first and second hull tanks for regulating the draft and horizontal position of said vessel wherein when said hull tanks are substantially filled with water said vessel is at a loading draft and when said hull tanks are substantially filled with air said vessel is at voyage draft;

(iii) a generally horizontal submersible platform;

(iv) a bearing bar projecting from said platform;

(v) a transverse truss coupled between said first and second hulls and generally perpendicular to said platform;

(vi) a support rail on said transverse truss for engaging said bearing bar and supporting said platform;

(vii) an air cell, subdivided longitudinally and transversely, beneath said platform;

(viii) a first air compressor;

(ix) first piping means for injecting air from said first air compressor into said air cell;

(x) a first valve which regulates the flow of air from said first air compressor into said air cell;

(xi) first vent piping means for ejecting air from said air cell;

(xii) a second valve which regulates the venting of air from said air cell;

(xiii) a second air compressor;

(xiv) second piping means for injecting air from said second air compressor into said hull tanks;

(xv) a third valve which regulates the flow of air from said second air compressor into said hull tanks;

(xvi) second vent piping means for ejecting air from said hull tanks;

(xvii) a fourth valve which regulates the venting of air from said hull tanks;

(xviii) a first plurality of sensors mounted on said platform providing feed-back on depth of immersion and horizontal position of said platform to said central processor;

(xix) a second plurality of sensors mounted on said hulls providing feed-back on depth of immersion and horizontal position of said hulls to said central processor; and (xx) a central processor including calculated flow rates for setting said first and third valves which regulate the flows of compressed air from said air compressors to said air cell and said hull tanks, respectively, and the calculated flow rates for said second and fourth valves which regulate the flows of air vented from said air cell and said hull tanks, respectively, wherein said method comprises the steps of:

(a) venting air at a first calculated rate from said first and second hull tanks through said second piping means enabling tanks to flood with water until said vessel is at a level wherein said platform contacts the water surface;

(b) venting air at a second calculated rate from said first and second hull tanks through said second piping means enabling tanks to flood with water until said vessel is at a level wherein said platform is at a programmed freeboard level;

(c) retracting said support rail to disengage from said bearing bar;

(d) venting air at a third calculated rate from said first and second hull tanks through said second piping means enabling tanks to flood with water until said vessel is at loading draft;

(e) venting air from said air cell through said first piping means until said platform is supported on said hulls and said cargo is freely floating; and (f) removing said cargo.

4. The method of claim 3 wherein said first calculated rate of venting air, said second calculated rate of venting air, and said third calculated rate of venting air are the same.

* * * * *